US006910759B2

(12) United States Patent
Kawamura et al.

(10) Patent No.: US 6,910,759 B2
(45) Date of Patent: Jun. 28, 2005

(54) LIQUID DISCHARGE RECORDING HEAD CARTRIDGE AND LIQUID DISCHARGE RECORDING APPARATUS

(75) Inventors: Shogo Kawamura, Shizuoka (JP); Toshiaki Hirosawa, Kanagawa (JP); Minoru Nozawa, Kanagawa (JP); Kyota Miyazaki, Tokyo (JP); Kenta Udagawa, Kanagawa (JP); Shuzo Iwanaga, Kanagawa (JP); Kazuhiko Okito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 510 days.

(21) Appl. No.: 09/900,866

(22) Filed: Jul. 10, 2001

(65) Prior Publication Data

US 2002/0071002 A1 Jun. 13, 2002

(30) Foreign Application Priority Data

| | | |
|---|---|---|
| Jul. 10, 2000 | (JP) | 2000-209094 |
| Jul. 10, 2000 | (JP) | 2000-209106 |
| Sep. 6, 2000 | (JP) | 2000-270224 |
| Sep. 6, 2000 | (JP) | 2000-270774 |

(51) Int. Cl.[7] ..... B41J 2/14; B41J 2/175
(52) U.S. Cl. ..... 347/50; 347/86
(58) Field of Search ..... 347/50, 85–87

(56) References Cited

U.S. PATENT DOCUMENTS

| | | | | |
|---|---|---|---|---|
| 5,262,802 A | * | 11/1993 | Karita et al. | 347/87 |
| 5,821,966 A | * | 10/1998 | Schell et al. | 347/86 |
| 6,102,533 A | * | 8/2000 | Nozawa et al. | 347/86 |
| 6,293,652 B1 | * | 9/2001 | Arashima et al. | 347/49 |

FOREIGN PATENT DOCUMENTS

| | | | |
|---|---|---|---|
| EP | 0 593 175 A2 | 4/1994 | B41J/2/16 |
| EP | 0 795 406 A2 | 9/1997 | B41J/2/16 |
| EP | 0 822 078 A2 | 2/1998 | B41J/2/14 |
| EP | 0 832 747 A2 | 4/1998 | |
| EP | 0 850 766 A2 | 7/1998 | B41J/2/175 |
| EP | 1 000 744 A2 | 5/2000 | B41J/2/14 |
| JP | 05-229131 | 9/1993 | |
| JP | 09-039276 | 2/1997 | |
| JP | 10-119314 | 5/1998 | |

OTHER PUBLICATIONS

U.S. Appl. No. 08/915,676, filed on Aug. 21, 1997.
U.S. Appl. No. 09/488,931, filed on Jan. 21, 2000.
U.S. Appl. No. 09/643,826, filed on Aug. 22, 2000.

* cited by examiner

*Primary Examiner*—Stephen D. Meier
*Assistant Examiner*—An H. Do
(74) *Attorney, Agent, or Firm*—Fitzpatrick, Cella, Harper & Scinto

(57) ABSTRACT

A liquid discharge head cartridge includes a recording element unit having a plate member with liquid supply paths for supplying liquid to a recording element base plate for recording by discharging the liquid; a liquid supply unit portion having a communication passage for conducting liquid from a liquid supply source; and an elastic sealing member that forms a seal between one end portion of the liquid supply paths of the plate member and an end portion of the communication passage facing the one end portion of the liquid supply paths. The elastic sealing member is provided with liquid flow paths communicating with the liquid supply paths and the communication passage. The liquid supply unit portion and the recording element unit are adhesively bonded with each other at locations other than those having the elastic sealing member arranged thereon.

10 Claims, 32 Drawing Sheets

LIQUID DISCHARGE RECORDING HEAD CARTRIDGE AND LIQUID DISCHARGE RECORDING APPARATUS

BACKGROUND OF THE INVENTION

1. Field of the Invention

The present invention relates to a liquid discharge recording head cartridge and a liquid discharge recording apparatus. The invention is not only applicable to the general recording apparatus, but also, to a copying machine, a facsimile apparatus provided with communication system, a word processor provided with a recording unit, or the like, as well as to a recording apparatus for industrial use which is complexly combined with various processing devices.

The term "printing" referred to in the description of the specification hereof is meant to include the formation of characters, graphics, and the other meaningful information, and also, include broadly images, figures, patterns, and others which are formed on a printing medium, and the processing of a printing medium as well, irrespective of whether such formation is meaningful or meaningless, and also, whether or not, apparent so as to be visually recognizable by a human. Here, the phrase "printing medium" is not only means to include paper used for the generating printing apparatus, but also, include cloths, resin film, metallic plate, glass, ceramics, wood, leather, and others which are receptive to liquid. Further, the term "liquid" (may be described as "ink" in some cases) should be interpreted broadly as in the case of the aforesaid "printing", and means the liquid which can be used for the formation of images, figures, patterns, and others, as well as for the processing of a printing medium or processing of ink (coagulation or insolubilization of colorant ink provided for a printing medium, for example), and is meant to include all the liquids that used in relation to printing.

2. Related Background Art

The ink jet recording apparatus is a recording apparatus of the so-called non-impact recording type, which makes it possible to record on various recording mediums at high speed without generating almost no sound, among some other advantages. The ink jet recording apparatus is, therefore, adopted widely for a printer, a word processor, a facsimile apparatus, a copying machine, and the like having recording mechanism provided therefor. The typical ink discharge method adopted for such ink jet recording apparatus is the one that uses electrothermal converting device. For this method, bubbles are created by heat generated by such electrothermal converting device. Then, by utilization of the pressure exerted when bubbles are created, liquid droplets are discharged from fine discharge ports to record on a recording medium.

For the ink jet recording apparatus, it has been demand increasingly more to record in higher image quality and higher precision. As a result, the mode, in which multiple color ink, processing liquid, or the like is used, is on the increase, it has been required, on the other hand, to make the recording apparatus itself smaller.

Under the circumstances, there is used an ink jet cartridge having a recording head unit and a liquid containing portion formed integrally, and further, as the container used for such cartridge, a container is arranged to be formed integrally with a plurality of liquid containing portions to make it possible to retain plural kinds of liquids at present. For a cartridge of the kind, a plurality of ink supply paths are provided for the recording head unit thereof so that a plurality of different kinds of liquids can be discharged. Also, as the mode of a recording head, there is the one in which the ink discharge port array is arranged in plural lines.

Meanwhile, the cartridge may be structured in some cases to include the recording head unit, the holder which is formed integrally with the head recording unit, and the container which is made attachable to and detachable from the holder. In this case, plural kinds of liquids can be held in one holder, but it is arranged to make each liquid containing portion detachable per color or to make plural kinds thereof detachable integrally for utilization depending on the mode of use.

In the coupling mode of the recording head unit in relation to the container and holder capable of retaining plural kinds of liquids integrally, a plurality of ink inducing tubes are concentrated on the holder portion. Therefore, in order to keep the airtightness of the supplying portion exactly, it has been conventionally practiced to adopt a sealing structure in which a sealant is used simply in general in such a manner as to bond the recording head unit provided with electrothermal converting devices and the ink flow paths formed on the liquid flow path formation member of the holder portion by the application of adhesive agent or the like after having positioned them, and then, to firmly fix the circumference of the ink inducing tubes by pouring in a sealant after having fixed the liquid flow path formation member.

With the coupling method that utilizes the sealant for sealing when coupling the ink supply paths of the recording head unit and the flow path formation member of the holder portion, the sealing strength between sealant and resin material is not sufficient enough so that the air is allowed to be accumulated in the ink jet recording head to block the ink supply into the discharge ports in some cases, and causes the "ink deficiency". Also, it is difficult to control the coating amount of sealant appropriately. Should the amount thereof be slightly short, there is no problem in the initial stage, but when the air accumulation is created in the ink jet recording head, it brings about the "ink deficiency" in some cases.

In the specification of Japanese Patent Application Laid-Open No. 10-119314, a head cartridge is disclosed, in which a head having a number of discharge ports and ink supply paths communicated with these discharge ports formed therefor, and an ink tank connecting portion having the ink flow paths communicated with the ink supply paths of this head formed therefor are integrally connected through a sealing member formed by an elastic material that seals such connecting portion. This method is simple and more reliable than the case where the head and ink tank connecting portion are integrated by use of adhesive agent without using any sealing member in consideration of the time required before the adhesive agent is hardened, and the control of the coating amount thereof as well.

SUMMARY OF THE INVENTION

It is an object of the present invention to provide at lower costs but more reliably a liquid discharge recording head cartridge having a tank holder portion and a recording element unit provided with the electric wiring base board, which are connected and fixed to enable them to be communicated in good condition with relatively simple means. The invention also aims at providing a liquid discharge recording apparatus.

In accordance with the present invention, an ink supply unit and a recording element unit are coupled under pressure by use of screws with a joint sealing member placed between them. Then, the ink supply paths of the ink supply unit and the recording element unit can be communicated in good condition and coupled without leaking ink. At this juncture, no adhesive agent is used on the circumference of the connecting portion of the ink supply paths of the recording element unit and the ink supply unit. There is no need for considering the defects that may be brought about by use of adhesive agent, thus making the coupling process relatively simple for highly reliable coupling at lower costs. Further, with the screw retaining portions being positioned outside the surface where an electric wiring tape is provided, the pressurized fixation is possible without exerting stress on the electric wiring tape.

The liquid discharge recording head cartridge of the invention is used with the carriage of a liquid discharge recording head main body, which is provided with a carrying mechanism for carrying a recording medium in one direction (direction Y), and a carriage, so that the liquid discharge surface is held to face the recording surface of the recording medium, and moved in the direction (direction X) orthogonal to the carrying the recording medium. Therefore, it is preferable to position the liquid discharge recording head cartridge of the invention in good precision and install it on the carriage for executing liquid discharges in higher positional precision. thus, it is desirable to provide for the cartridge an abutting portion in the direction X, an abutting portion in the direction Y, and an abutting portion in the direction Z used for positioning at the time of installation on the carriage.

The abutting portion in the direction X is used when the cartridge is mounted on the carriage. Usually, therefore, this portion is provided for the liquid supply unit side which is in contact with the carriage when being mounted. In this case, then, the first plate is provided with the referential surface in the direction X, and it is preferable to couple the liquid supply unit and the first plate in a state of being positioned with the referential surface in the direction X abutting against the abutting portion in the direction X. In this way, the recording element unit, which is provided with the recording element base plate having discharge ports arranged therefor to discharge liquid, can be positioned in good precision with respect to the abutting portion in the direction X. Particularly, it becomes possible to enhance the positional precision of the discharge ports by enabling the referential surface in the direction X used for positioning the recording element unit to abut against the abutting portion in the direction X.

Likewise, in the direction Y, when the abutting portion in the direction Y is provided for the liquid supply unit, and the first plate is provided with the referential surface in the direction Y, it is preferable to couple the liquid supply unit and the first plate in a state of being positioned with the referential surface in the direction Y abutting against the abutting portion in the direction Y. Also, in the direction Z, the upper face of the screw retaining boss where the first plate is arranged to abut upon is formed to keep the tolerance of thereof to be within a ranged of designated tolerance with respect to the abutting face of the abutting portion in the direction Z. In this manner, the positional precision of the recording element unit can be enhanced in the direction Z.

For the liquid discharge recording head cartridge of the invention, if it is arranged to keep the pressurized contact face of the first plate with the liquid supply unit to be in contact with the liquid supply unit only by the contact portion through the contacting part of the screw retaining boss, and the portion of the joint sealing member having the liquid inlet ports opened thereto, the contact pressure is effectively exerted on the abutting portions of the liquid supply paths of the liquid supply unit and the liquid supply ports of the recording element unit through the joint sealing portion, thus making it possible to connect the liquid inlet ports with liquid supply ports firmly.

Also, if it is arranged to distribute a plurality of the liquid supply ports of the first plate almost in one line to be opened, and arrange the screw retaining portions in two end portions on the central line of the array of the liquid supply ports, pressure can be exerted effectively in the vicinity of the central line to connect the liquid inlet ports and the liquid supply ports firmly.

For the liquid discharge recording head cartridge of the invention, it is preferable to form the first plate, which supports the recording element base plate, while being in contact with the liquid supply unit under pressure by the material which is not easily deformed. It is, therefore, desirable to form this plate using ceramic material. Also, the structure of the ink supply member is complicated and relatively precise. For the material thereof, resin material is preferable. Also, it is desirable to form the joint sealing member by the material the compression set of which is small.

Also, if the face on which abuts the head of the screw retaining boss, and the upper face of the head of the screw are recessed from the surface of the first plate having the wiring board installed thereon, it becomes possible to reduce the adhesion of mist like liquid to this portion resulting from the liquid discharges, thus preventing a recording medium from being stained by the adhesion of liquid which has already adhered to such portion.

Also, if the screw retaining boss is installed on one and the same member forming the portion having the liquid inlet ports opened thereto, it becomes possible to enhance the relative positional precision of the upper faces of the screw retaining portion and the portion having the liquid inlet ports opened thereto, thus enabling the first plate to abut against the portion to which the liquid supply paths are open in good precision to apply an appropriate contact pressure. The coupling reliability is enhanced more if the liquid supply unit and the first plate are bonded by use of adhesive agent in addition to the use of screws for coupling.

If the liquid supply unit portion and the recording element unit are adhesively bonded to each other for coupling on the bonding face portion other than the location where the elastic sealing member is arranged under pressure, there is no need for the application of adhesive agent between the one end portion of the liquid supply path of the recording element unit and the communicating passage of the liquid supply unit. As a result, it becomes unnecessary to control the coating amount of adhesive agent rigidly, thus making the assembling of a recording head faster and easier.

When an adhesive agent is filled in a space formed by the elastic member, the second base plate, and the outer circumference of the flow paths of the flow path formation member, the communicating portion is sealed from the outside both by the elastic member and the adhesive agent, and the sealing strength is enhanced. Thus, it becomes possible to prevent ink from leaking from the contact portion of the second base plate and the outer circumference of the flow paths of the flow path formation member or to prevent the air from entering the flow paths from such contact portion. Also, with the aforesaid space being filled in by the adhesive agent, only the adhesive agent is in contact with ink even if there is an ink leakage from the contact portion. There is no possibility that ink is directly in contact with the elastic member. As a result, it becomes possible to prevent discharge defects due to oil or other impurities adhering to the elastic member or to prevent ink from being condensed by the partial elution of the elastic member into the ink flow paths. In this way, the reliability of an ink jet recording head can be enhanced, while the recording quality is improved by the stabilized ink bubbling.

With the sealing member having a plurality of sealing portions planted in circular each with flat and smooth surface on the mat portion having satin surface, it becomes possible to prevent sealing members from sticking to each other when a number of them are handled. Thus, the handling thereof is made easier. Also, there is no need for using material having a large hardness as in the conventional art. It is still possible to secure a good sealing capability by use of a soft material.

Here, if the center line average roughness of the satin surface of the mat portion is kept within a range of 10 to 50 μm, the sealing members can be prevented from sticking to each other assuredly. If the center line average roughness of the flat and smooth surface of the sealing portion is set at 10 μm or less, a good sealing capability can be secured. When the sealing member is formed by chlorinated butyl rubber having hardness (JIS A) within a range of 30 to 50, it becomes possible to secured the reliability of the sealing member for a long time.

For the liquid discharge recording head carriage of the invention or the image forming apparatus, if the center line average roughness of the portion abutting against the liquid tank connection portion and the sealing portions of the sealing member of the liquid discharge head is set at 0.5 μm or less or if a smoothing layer is formed for the abutting portion of the liquid tank connecting portion and the sealing portions of the sealing member of the liquid discharge head for smoothing the surface thereof, it becomes possible to secure a good sealing capability between the liquid tank connecting portion and the liquid discharge head.

BRIEF DESCRIPTION OF THE DRAWINGS

FIG. 1A shows the state where an ink tank is installed, and FIG. 1B shows the state where the ink tank is removed.

FIG. 9A is the lower face plane view; FIG. 9B, the side view; and FIG. 9C, the upper face plane view.

FIG. 11A is the plane view and FIG. 11B, the side view.

FIG. 12A is the plane view and FIG. 12B, the side view.

DETAILED DESCRIPTION OF THE PREFERRED EMBODIMENTS

Hereinafter, with reference to the accompanying drawings, the description will be made of the embodiments of a liquid discharge recording head cartridge in accordance with the present invention.

<First Embodiment>

(Embodiment 1-1)

FIGS. 1A and 1B to FIG. 10 are views which illustrate the recording head cartridge (liquid discharge recording head cartridge) embodying the present invention or to which the present invention is preferably applicable, and the recording head unit and the ink tank portion that retains ink (liquid), respectively, for the cartridge, as well as the respective relations between them. Hereunder, with reference to these figures, each of the constituents will be described.

Figure 1B:
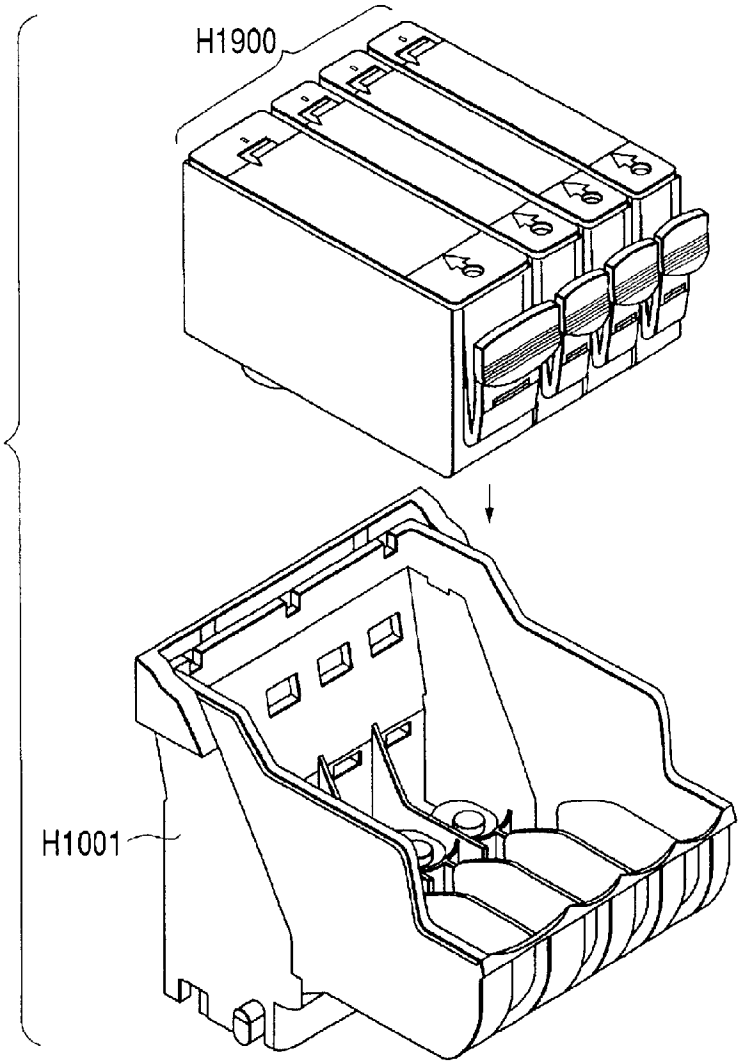
FIGS. 1A and 1B are perspective views which illustrate a recording head cartridge in accordance with the embodiment 1-1 of the present invention.
Figure 1A:
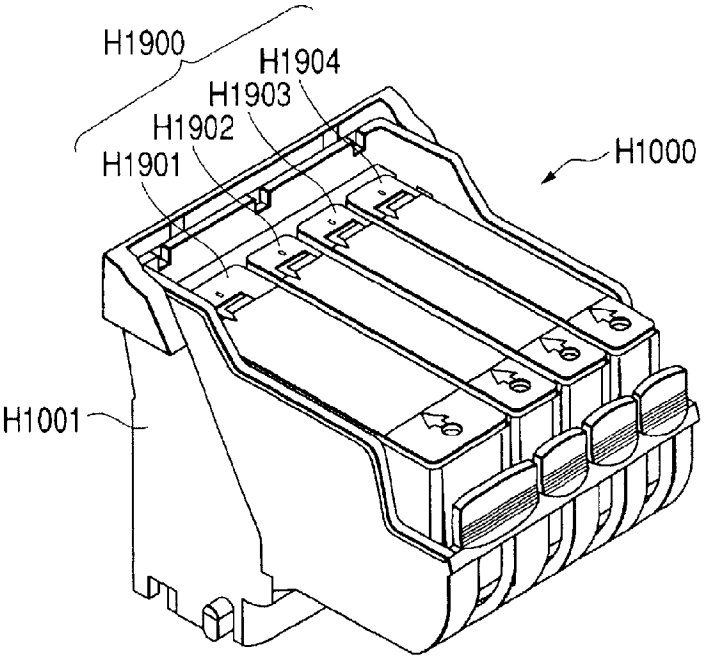

As understandable from the perspective views of FIGS. 1A and 1B, the recording head unit H1001 of the present invention is one constituent that forms a recording head cartridge H1000. The recording head cartridge H1000 is formed by the recording head unit H1001 and the ink tank H1900 which is detachably attachable thereto. The recording head cartridge H1000 is positioned by positioning means to the carriage (not shown) of the ink jet recording apparatus main body, and mounted to be electrically connected by the electric contacts and supportably fixed, while being arranged to be detachably attachable to the carriage.

As the ink tank H1900, there are arranged four, that is, an ink tank H1901 for use of black ink; an ink tank H1902 for use of cyan ink; an ink tank H1903 for use of magenta ink; and an ink tank H1904 for use of yellow ink. These ink tanks H1901, H1902, H1903, and H1904 are arranged each to be detachably attachable to the recording head unit H1001 individually. Then, each of them is made to be exchangeable, respectively. With the structure thus arranged, each of the ink tanks H1900 is replaced appropriately in order to use ink without waste, thus suppressing the running costs of printing by use of the ink jet recording apparatus.

Next, regarding the recording head unit H1001, the description will be made further in detail of each constituent thereof one after another.

(1) Recording Head Unit

The recording head which is installed on the recording head unit H1001 is a recording head of bubble jet type that uses electrothermal converting devices to generate thermal energy for crating film boiling in ink in accordance with electric signals, which is arranged so as to enable the electrothermal converting devices and ink discharge ports to face each other, that is, the recording head of the so-called side shooter type.

Figure 2:
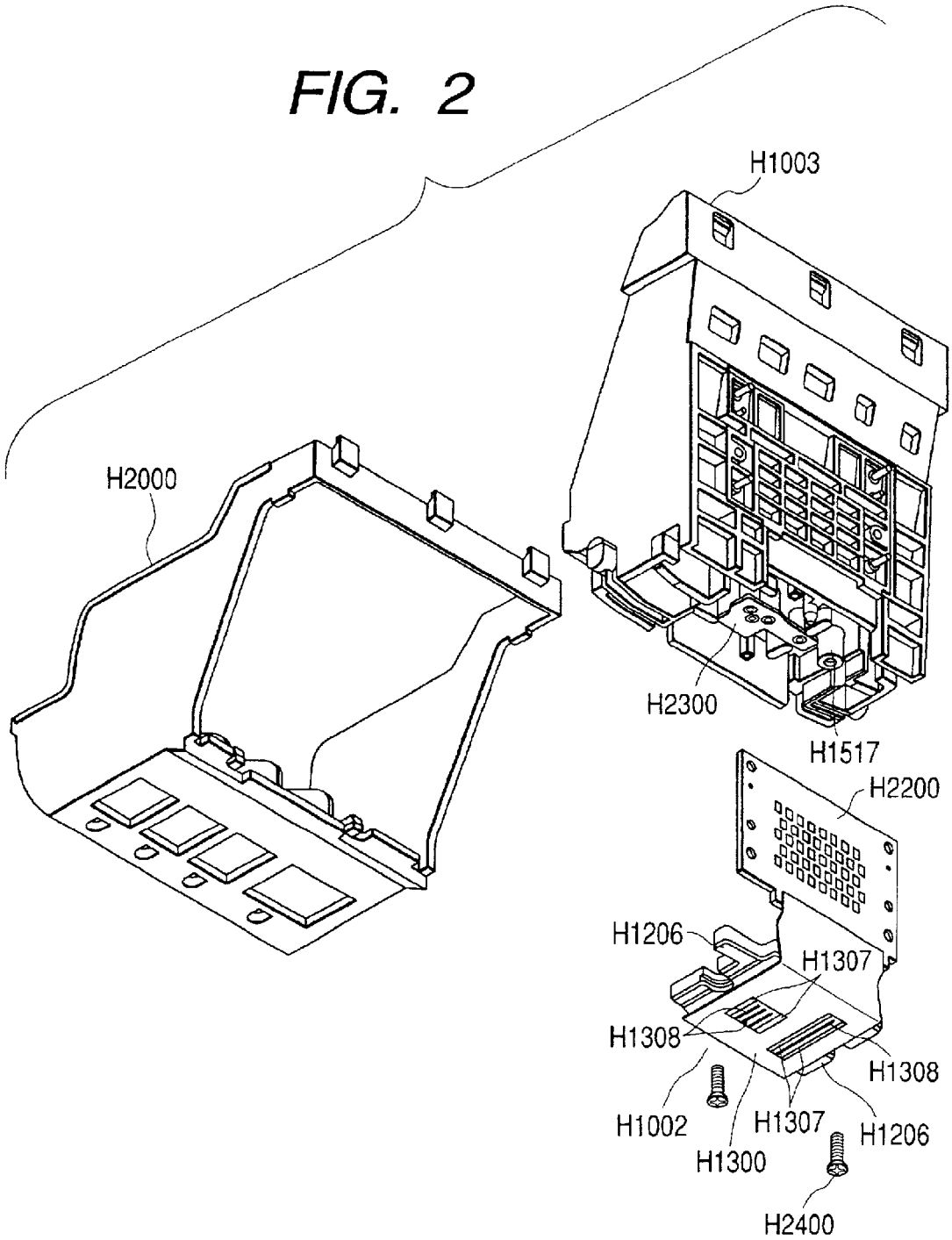
FIG. 2 is an exploded perspective view which shows the recording head unit of the recording head represented in FIGS. 1A and 1B.

As shown in the exploded perspective view of FIG. 2, the recording head unit H1001 comprises a recording element unit H1002; an ink supply unit (liquid supply unit) H1003; and a tank holder H2000.

Figure 3:
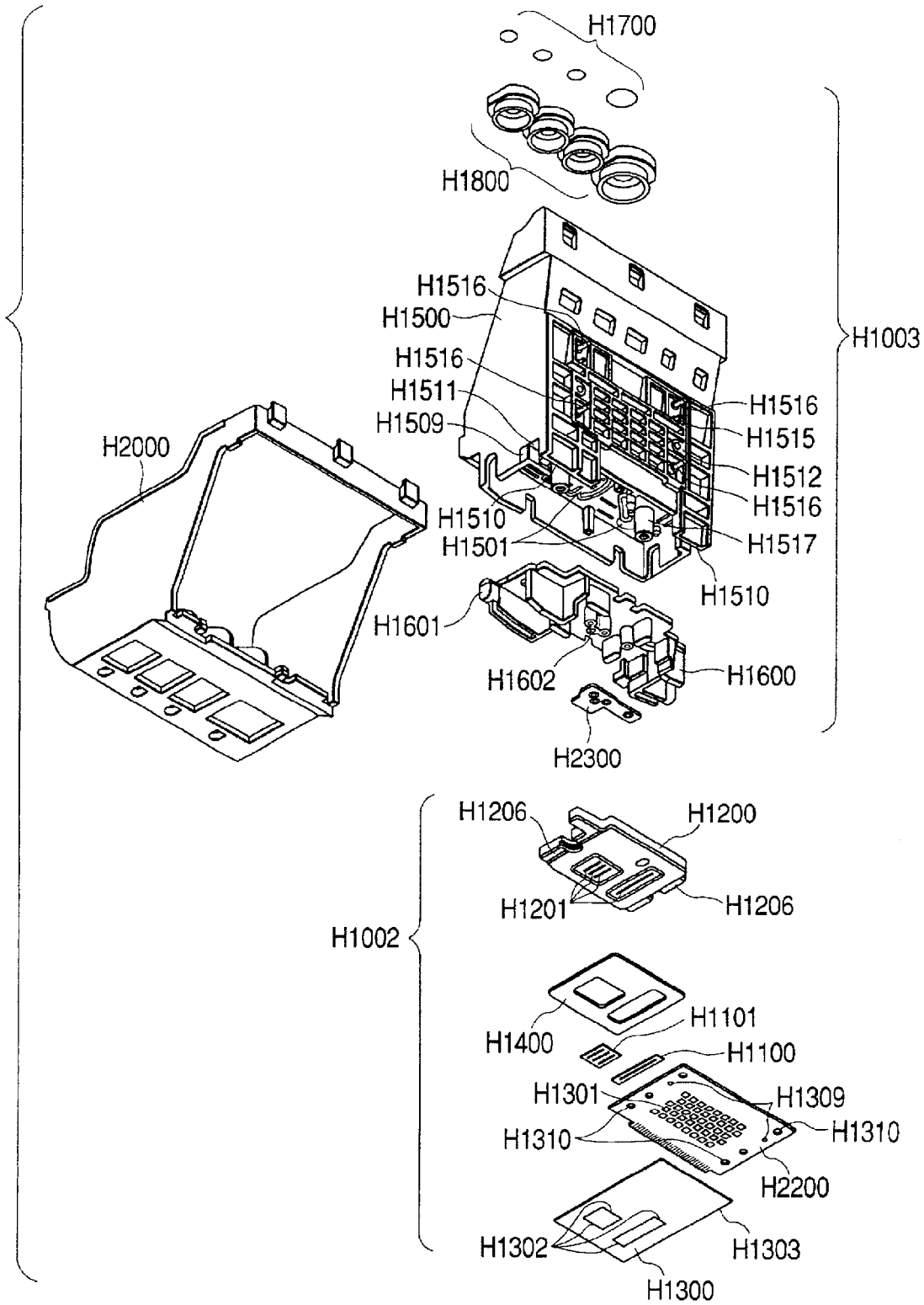
FIG. 3 is an exploded perspective view which shows further in detail the recording head unit of the recording heat cartridge represented in FIGS. 1A and 1B.

Further, as shown in the exploded perspective view of FIG. 3, the recording element unit H1002 comprises a first recording element base plate H1100; a second recording element base plate H1101; a first plate H1200; an electric wiring tape (electric wiring base board) H1300; an electric contact base board H2200; and a second plate H1400. Also, the ink supply unit H1003 comprises an ink supply member H1500; a flow path formation member H1600; a joint sealing member H2300; a filter H1700 and a sealing rubber H1800.

(1-1) Recording Element Unit

The first plate H1200 is formed by alumina ($Al_2O_3$) material in a thickness of 0.5 to 10 mm. The material of the first plate H1200 is not necessarily limited to alumina. It may be possible to use some other material that presents the same linear expansion coefficient as that of the material used for the recording element base plates H1100 and H1101, and also, presents the thermal conductivity equal to more than that of the material used for the recording element base plates H1100 and H1101. Now, therefore, the material of the first plate H1200 may be either one of silicon (Si), aluminum nitride (AlN), zirconium, silicon nitride ($Si_3N_4$), silicon carbide (SiC), molybdenum (Mo), and tungsten (W), for example. For the first plate H1200, there are ink supply ports for supplying black ink to the first recording element base plate H1100 and those for supplying cyan, magenta, and yellow ink to the second recording element base plate H1101 as the ink supply port H1201. Also, for both side portions, each screw retaining portion H1206 is formed as the mechanically connecting portion, respectively, for connecting the ink supply unit H1003.

Figure 4:
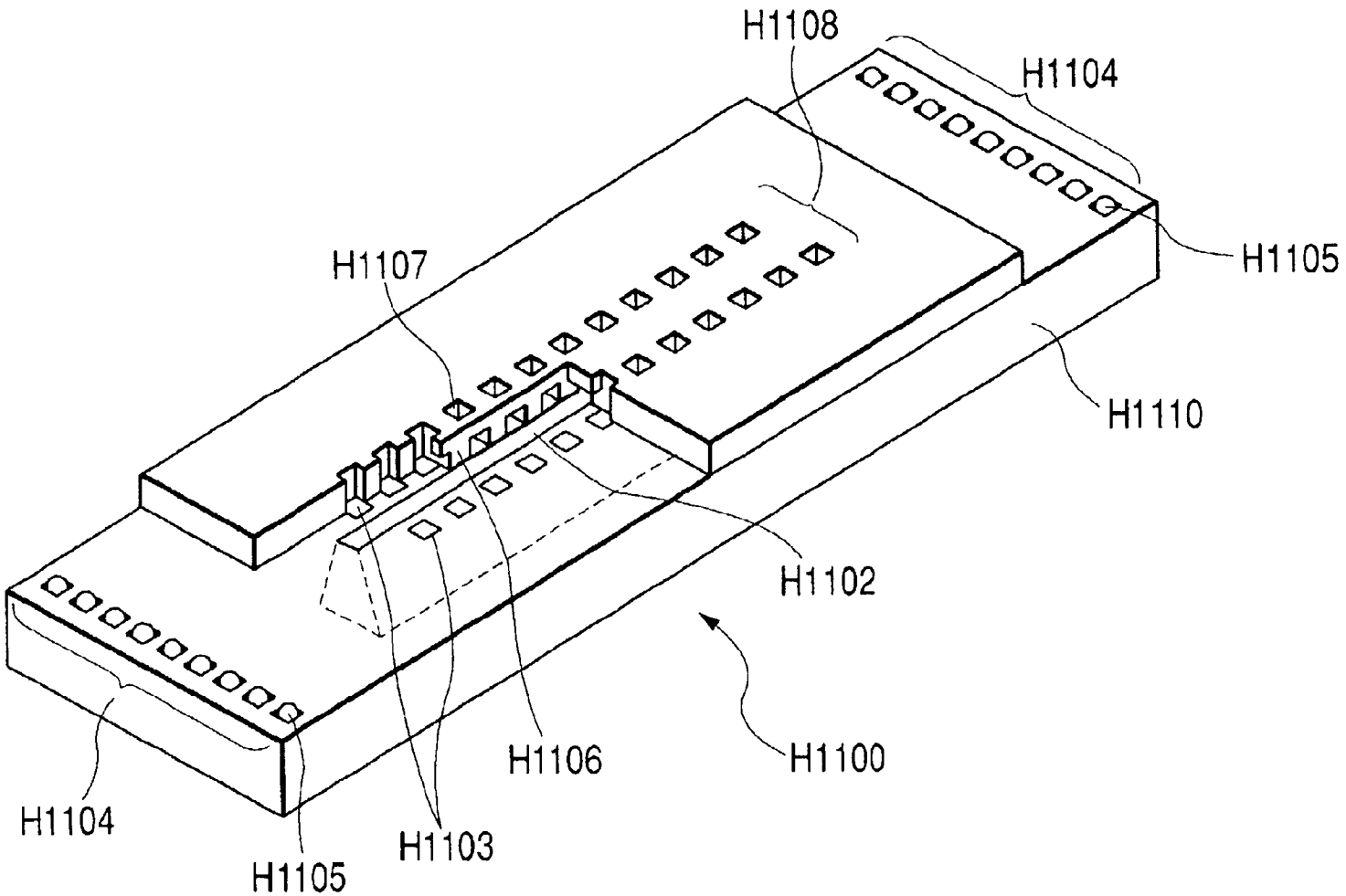
FIG. 4 is a partially broken perspective view which shows a first recording element base plate of the recording head cartridge represented in FIGS. 1A and 1B.

FIG. 4 is a partially broken perspective view for illustrating the structure of the first recording element base plate H1100 for black ink use, the use frequency of which is high. For the first recording element base plate H1100, the ink supply port H1102 is formed on the Si base plate H1110 of 0.5 to 1 mm thick, for example, which is an elongated groove type through opening serving as an ink flow path. On both sides across the ink supply port H1102, there are formed electrothermal converting devices H1103 arranged in one line, respectively. Further, an electric wiring (not shown) formed with Al or the like is formed to supply electric power to the electrothermal converting devices H1103. These electrothermal converting devices H1103 and the electric wiring are formed by means of film formation technologies and techniques. The electro-thermal converting devices H1103 are arranged in zigzag, that is, each position of discharge port arrays is slightly deviated so as not to allow them to be aligned in the direction orthogonal to the direction of line arrangement. Further, the electrode portion H1104 for supply electric power to the electric wiring is each arranged along the side of both outer sides of the electrothermal converting devices H1103. On the electrode portion H1104, bumps H1105 are formed with Au or the like.

Then, on the surface of the Si base plate H1110 where these are formed, there are provided the ink flow path walls H1106 that form the ink flow paths corresponding to the electrothermal converting devices H1103, and a ceiling portion that covers above them. The ceiling portion is provided with a structure of resin material with the openings of discharge ports H1107, which is formed by means of photolithographic technique. The discharge ports H1107 are provided corresponding to the electrothermal converting devices H1103 to form a discharge port group H1108. In this first recording element unit H1100, the ink which is supplied form the ink flow path H1102 is discharged from the discharge port H1107 that faces each of the electrothermal converting devices H1103 by means of the pressure exerted by bubble created by heat generated by each of the electrothermal converting devices H1103.

Figure 5:
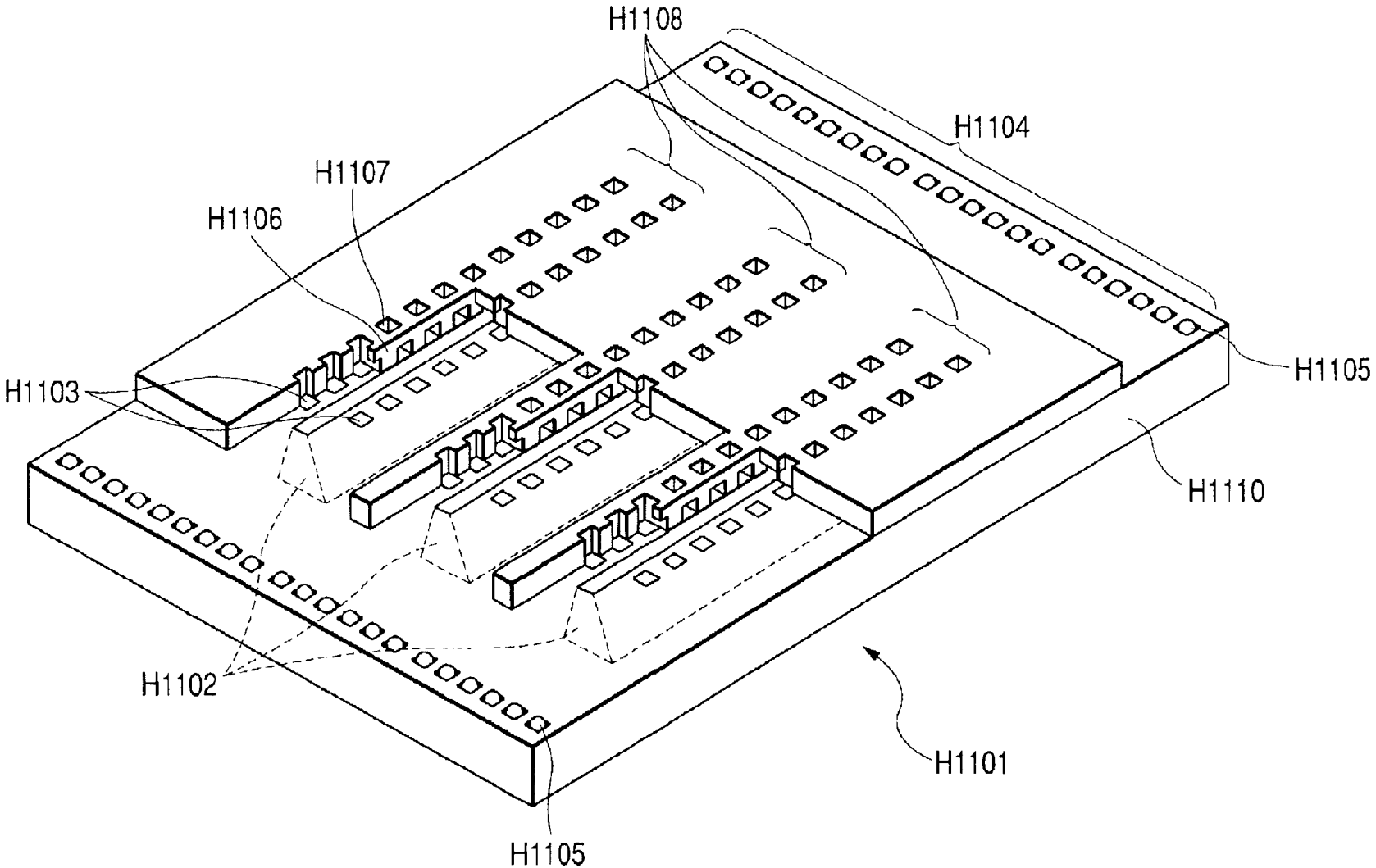
FIG. 5 is a partially broken perspective view which shows a second recording element base plate of the recording head cartridge represented in FIGS. 1A and 1B.

Also, FIG. 5 is a partially broken perspective view of the second recording element base plate H1101, which illustrates the structure thereof. The second recording element base plate H1101 is arranged for discharging ink of three colors, that is, cyan, magenta, and yellow. Three ink supply ports H1102 are formed in parallel. On both sides across each of the ink supply ports H1102, there are arranged in the zigzag form the electrothermal converting devices H1103 and ink discharge ports H1107 each in one line. Then, further, on the Si base plate H1110, the electric wiring and electrode portions H1104 are arranged as in the case of the first recording element base plate H1100, and the ink flow path walls H1106 and ink discharge ports H1107 are formed thereon with resin material by means of the photolithographic techniques. Then, as in the first recording element base plate, the bumps H1105 are formed with Au or the like for the electrode portions H1104 for supply electric power to the electric wiring. The recording element base plates H1100 and H1101 are connected so that each of the ink supply ports H1102 is communicated with the ink supply port H1201 of the first plate H1200, and then, each of them is adhesively fixed so as to be positioned to the first plate H1200 in good precision. The first adhesive agent which is used for this bonding should preferably provide a low viscosity with a low hardening temperature so that it is hardened in a short period of time with a relatively high hardness after having been hardened, as well as provide good resistance to ink. In this respect, a thermohardening adhesive agent with epoxy resin as the main component thereof is used, for example. It is then desirable to make the adhesive layer in a thickness of 50 $\mu$m or less.

The second plate H1400 is a one plate type member in a thickness of 0.5 to 1 mm, for example, which is formed by ceramics, such as alumina ($Al_2O_3$), or metallic material, such as Al or SUS, and formed in a shape having two openings each in the outer dimension which is larger than the first recording element base plate H1100 adhesively fixed to the first plate H1200, and the second recording element base plate H1101, respectively. The second plate H1400 is bonded to the first plate H1200 by use of a second adhesive agent. In this way, when the electric wiring tape H1300 is adhesively fixed, the electric wiring tape H1300 is in contact with the first recording element base plate H1100 and the second recording element base plate H1101 on the flat plane of the bonding surface to effectuate the electric connection.

The electric wiring tape H1300 forms the electric signal passage through which electric signals are applied to the first recording element base plate H1100 and the second recording element base plate H1101. For the electric wiring tape H1300, there are formed two openings with respect to each of the recording element base plates H1100 and H1101. Around the edge of each opening, the electrode terminal H1302 is formed to be connected with each electrode portion H1104 of the recording element base plates H1100 and H1101. On the end portion of the electric wiring tape H1300, there are formed the electric contact base plate H2200 which is provided with the external signal input terminal H1301 to receive electric signals, and the electric terminal connecting portion H1303 which conducts the electrical connection. Then, the electrode terminal H1302 and the electric terminal connecting portion H1303 are coupled by use of a copper foil wiring pattern.

The backside of the electric wiring tape H1300 is adhesively fixed on the lower face of the second plate H1400 by use of a third adhesive agent. Further, this wiring tape is folded to one side face side of the first plate H1200, thus being adhesively fixed to the said face of the first plate H1200. As the third adhesive agent, a thermal hardening adhesive agent, the main component of which is epoxy resin, is usable in a thickness of 10 to 100 $\mu$m, for example.

The electric connection of the electric wiring tape H1300 with the first recording element base plate H1000 and the second recording element base plate H1101 is effectuated by electrically welding each electrode portion H1104 of the recording element base plates H1100 and H1101 with the electrode terminal H1302 of the electric wiring tape H1300 by means of thermally pressurized ultrasonic method. Then, the electrically connected portion of the first recording element base plate H1100, the second recording element base plate H1101, and the electric wiring tape H1300 is sealed by use of the first sealant H1307 and the second sealant H1308. In this manner, the electrically connected portion is protected from erosion caused by ink, as well as from the external shocks. The first sealant H1307 is mainly used for sealing from the backside of the connected portion of the electrode terminal H1302 of the electric wiring tape with each electrode portion H1104 of the recording element base plates H1100 and H1101, and also, used for sealing the outer circumferential portion of the recording element base plates H1100 and H1101. The second sealant H1308 is used for sealing from the front side of the connected portion.

To the end portion of the electric wiring tape H1300, the electric contact base plate H2200 is electrically connected by means of thermally pressurized bonding that uses an anisotropic conductive film or the like. For the electric contact base plate H2200, there are formed a terminal positioning hole H1309 to be used for positioning and a terminal coupling hole H1310 to be used for fixation.

(1-2) Ink Supply Unit

As shown in FIG. 3, an ink supply member H1500 is one structural member to form the ink supply unit H1003 to induce ink from the ink tank H1900 to the recording element unit H1002. The ink supply member H1500 is formed by resin molding, for example. For the resin material therefor, it is desirable to use the one in which glass filler is mixed by 5 to 40% in order to enhance the shaping robustness.

Figure 6:
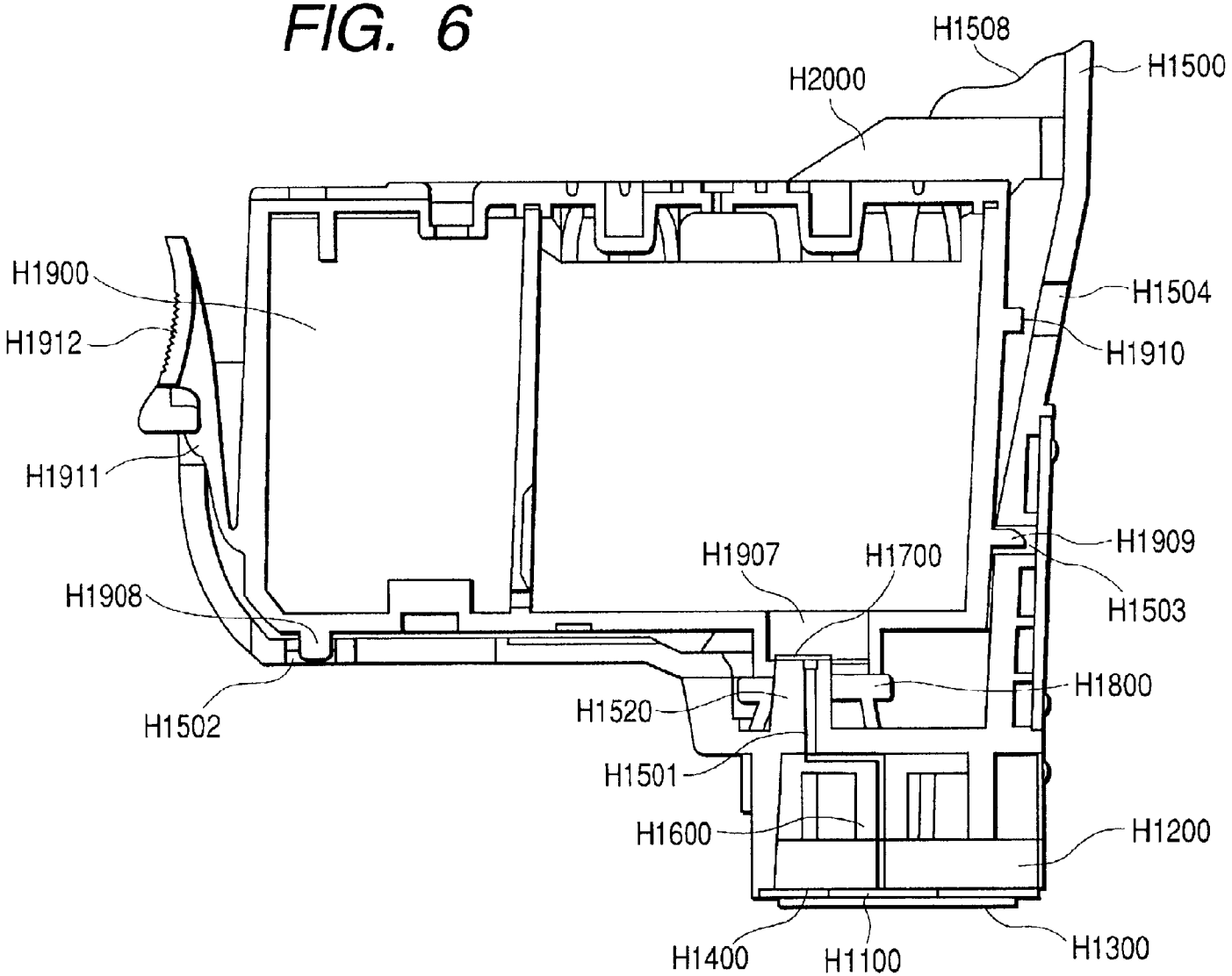
FIG. 6 is a side sectional view which shows the recording head cartridge represented in FIGS. 1A and 1B.

As shown in FIG. 6, the ink supply member H1500 forms a holding portion that detachably holds the ink tank H1900 in cooperation with the tank holder H2000. For this holding portion, a tank positioning hole H1502 is provided on the bottom portion thereof to be coupled with the tank positioning pin H1908 of the ink tank H1900. Then, on the wall on the rear side, there are provided the first hole H1503 that engages with the first nail H1909 of the ink tank, and the second hole H1504 that engages with the second hail H1910. Also, on the front portion of the ink tank H1900, a movable lever H1912 is provided with the third nail H1911 which engages with the wall of the holding portion. With a force to deform this lever H1012 elastically, the third nail H1911 is released remove the ink tank H1900. Of these structures, the holes H1503 and H1504 are formed for the ink supply member H1500. In other words, the ink supply member H1500 constitutes a part of means for holding the ink tank H1900 which is detachably attachable.

For the ink supply member H1500, the joint portion H1520, which abuts against the ink supply port H1907 portion of the ink tank H1900, is arranged on the bottom position of the holding portion for the ink tank H1900. Here, a filter H1700 is bonded by welding in order to prevent dust particles from entering from the outside. Further, a sealing rubber H1800 is provided in order to prevent ink from evaporating from the joint portion H1520. In the ink supply member H1500, an ink flow path H1501 is formed to be extended to the lower face from the contacting face of the joint portion H1520 with the ink tank H1900.

On the bottom face of the ink supply member H1500, the flow path formation member H1600, to which the ink (liquid) inlet port H1602 is open for supplying ink to the recording element unit H1002, is positioned to enable the ink inlet port H1602 to be communicated with the ink flow path H1501 of the ink supply member H1500, and fixed by means of ultrasonic welding.

Also, for this ink supply unit H1003, a structure is formed to install the recording head cartridge H1000 on the ink jet recording apparatus main body. In other words, on the side portion of the flow path formation member H1600, an installation guide H1601 is provided for guiding the recording head cartridge H1000 to the carriage installing position by being in contact with the corresponding portion of the carriage. Also, on the upper part of the ink supply unit H1003, a coupling portion H1508 is provided for installing and fixing the carriage on the recording head cartridge H1000 by being in contact with the head setting lever which is arranged on the main body side. Also, an abutting portion H1509 in the direction X (the direction of the recording head movement), an abutting portion H1510 in the direction Y (the direction of the recording medium conveyance), and an abutting portion H1511 in the direction Z (the direction of ink discharges) are formed on the bottom face of the ink supply member as the abutting references whereby to position the recording head cartridge H1000 at the designated installing position by allowing them to abut against the corresponding portions of the carriage.

Also, on the backside of the ink supply unit H1003, there are formed the terminal fixing portion H1512 on which the electric contact base plate H2200 of the recording element unit H1002 abuts to be fixed; the terminal positioning pin H1516 for use of positioning; and the terminal coupling pin H1515 which serves as fixing means for the electric contact base plate H2200. Then, on the circumference of these members, a plurality of ribs are arranged to enhance the robustness of the plane where the terminal fixing portion H1512 is provided.

Also, on the bottom face of the ink supply unit H1003, the screw retaining boss H1517 is provided and used for connection with the recording element unit H1002. For the present embodiment, the screw retaining boss H1517 is formed on the bottom face of the ink supply member H1500.

(1-3) Coupling Between the Recording Head Unit and the Ink Supply Unit

Next, the description will be made of the coupling between the recording head unit H1002 and the ink supply unit H1003.

The recording element unit H1002 and the ink supply unit H1003 are coupled by being pressed by means of a screw H2400 to be in contact for fixation with the joint sealing member H2300 between them, which is provided with a hole positioned corresponding to the ink supply port H1201 of the first plate H1200, and the ink inlet port H1602 of the flow path formation member H1600. The joint sealing member H2300 is formed by an elastic material, such as rubber, having a small compression set. Then, with this sealing member, the ink supply port H1201 and ink inlet port H1602 are pressed to be in contact, having the sealing member between them to communicate in good condition so as not to allow any ink leakage to occur.

At this juncture, the recording element unit H1002 and ink supply unit H1003 are positioned in good precision in the direction X and direction Y and fixed in such a manner that the two referential surfaces H1205 in the direction Y and one referential surface H1206 in the direction X provided for the end face of the first plate H1200 of the recording element unit H1002 are allowed to abut against the abutting portion H1510 in the direction Y and abutting portion H1509 in the direction X provided for the ink supply member H1500. The abutting portion H1509 in the direction X and abutting portion H1510 in the direction Y are, as described earlier, used dually for positioning the recording head cartridge H1100 to the carriage. Therefore, the recording element unit H1002 is positioned in high precision with respect to the carriage. Also, the abutting face of the screw retaining boss H1517 of the ink supply member H1500 against the first plate H1200 are formed in good precision by controlling the dimension from the abutting portion H1511 in the direction Z. Then, with a part of the backside of the plane, on which the recording element base plates H1100 and H11001 of the first plat H1200 are fixed, being allowed to abut against the screw retaining boss H1517, the recording element unit is positioned in the direction Z in good precision and fixed.

Figure 9A:
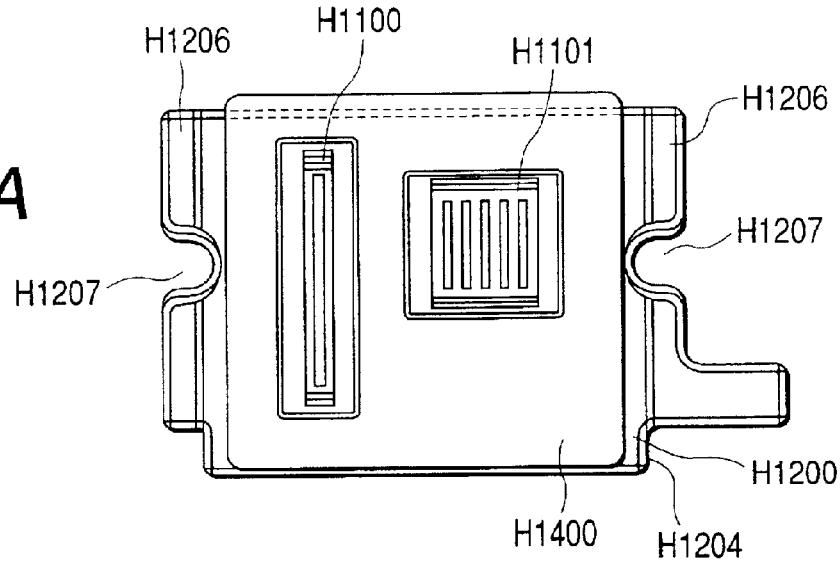
FIGS. 9A, 9B, and 9C are views which illustrate the state where a first plate, a second plate, a first recording element base plate, and a second recording element base plate are coupled for the recording head cartridge represented in FIGS. 1A and 1B.
Figure 9B:
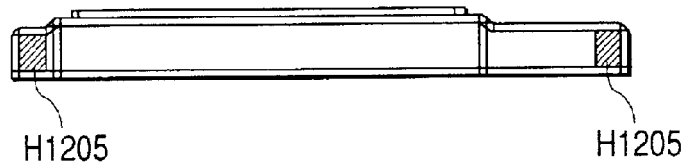
Figure 9C:
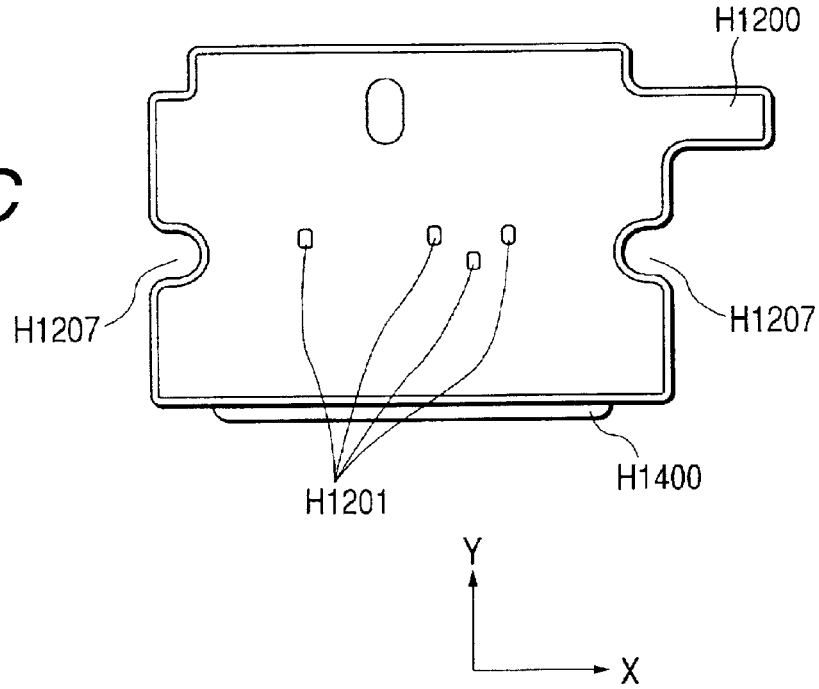

Also, for the first plate H1200, a plurality of ink supply ports H1201 are arranged almost in line in the direction Y as shown in FIG. 9C, and the screw fixing positions H1207 are positioned on the line X running through almost the central portion of the ink supply ports H1201 in the direction Y across the end portions of the first plate in the direction X. In this manner, it becomes possible to exert a force effectively on the joint sealing member H2300 to press it to be in contact near the ink supply port H1201 and ink inlet portion H1602, hence obtaining a good sealing performance.

Figure 10:
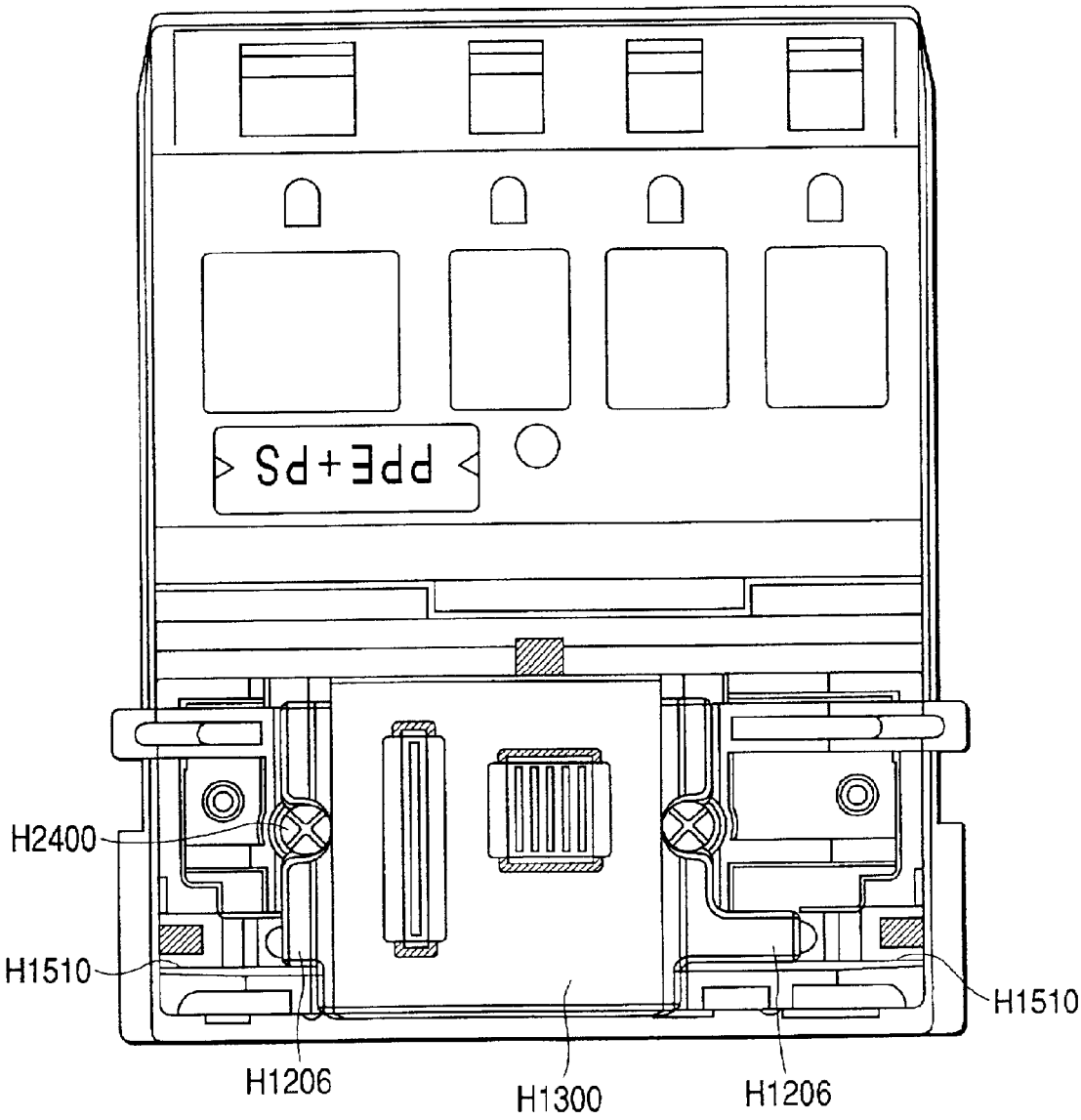
FIG. 10 is a lower face plane view which shows the recording head cartridge represented in FIGS. 1A and 1B.

At this juncture, each screw retaining portion H1206 of the first plate H2000 is provided outside the area where the second plate H1400 is fixed and the electric wiring tape H1300 is installed, and as shown in FIG. 10, when the recording element unit H1002 is fixed to the ink supply unit H1003 by use of the screw H2400, the head of the screw H2400 is not allowed to be overlapped on the electric wiring tape H1300. As a result, the pressurized fixation is possible without exerting any unwanted stress on the electric wiring tape H1300. Also, it is desirable to provide sealing for the screw H2400 so as not to allow ink to adhere thereto and enter the inside through it. The screw fixing position H1207 should preferably be set at a location which has a slight room between the head of the screw H2400 and the face where the second plate H1400 is adhesively fixed, thus making the sealing possible.

Further, the upper face of the screw retaining portion H1206 is recessed by 0.5 mm to 1 mm from the plane where the second plate H1400 is adhesively bonded. Then, dimension is arranged so as not to allow the head of the screw H2400 to protrude above this plane. In this way, it is made possible to reduce the adhesion of excessive ink to the plane of the first plate H1200 outside the electric wiring tape H1300, that is, the screw retaining portion H1206 or the screw H2400, due to the adhesion of ink mist generated by the repeated recording or due to the partial stagnation of ink when recovery means operates to wipe the ink discharge surface of the recording head for removing ink, thus preventing a recording medium from being stained by the ink that has adhered to such portion.

Then, the electric contact base plate H2200 of the recording element unit H1002 is positioned and fixed to the backside of the ink supply member H1500. The electric contact base plate H2200 is positioned by putting the two terminal positioning pins H1515 provided for the backside of the ink supply unit H1003 through the terminal positioning holes H1309, respectively. At this juncture, the terminal coupling pints H1516 of the ink supply unit H1003 are put through the terminal coupling holes H1310, respectively, and then, fixation is made by caulking the terminal coupling pins H1516. Here, the fixing method is not necessarily limited thereto. Any other fixing means may be adoptable for this fixation.

Figure 7:
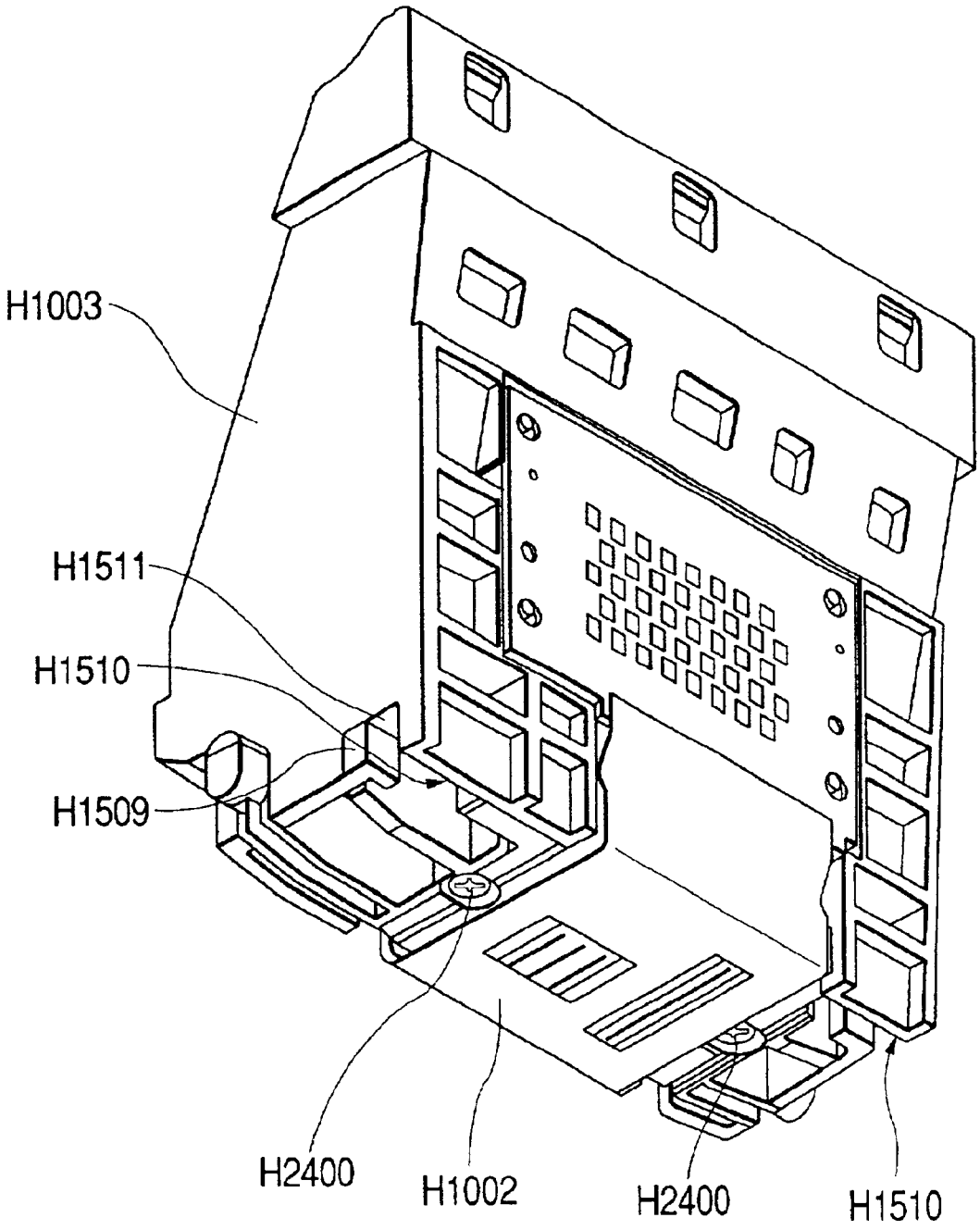
FIG. 7 is a perspective view which shows the state where the ink supply unit and the recording element unit are coupled for the recording head cartridge represented in FIGS. 1A and 1B.
Figure 8:
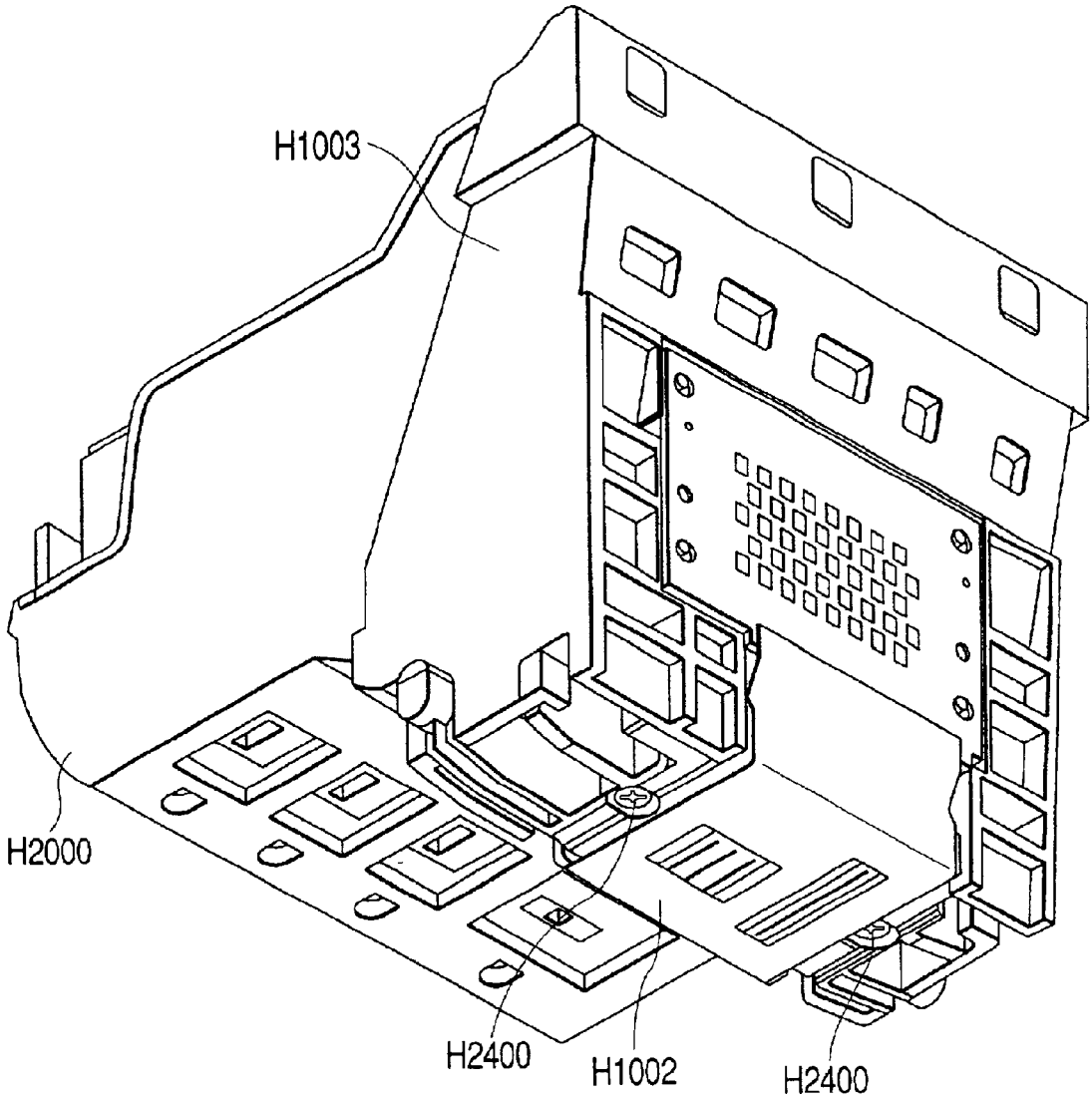
FIG. 8 is a perspective view which shows the state where the recording head unit is assembled for the recording head cartridge represented in FIGS. 1A and 1B.

FIG. 7 shows the state where the ink supply unit H1003 and recording element unit H1002 are coupled as described above. Further, the tank holder H2000 is coupled by fitting the coupling holes and coupling portions provided for the ink supply member H1500 and tank holder H2000 into each other as shown in FIG. 8, and the recording head cartridge H1001 is completed.

As described above, in accordance with the present embodiment, the ink supply unit H1003 and the recording element unit H1002 are pressed to be in contact by use of the screws H2400, and coupled together with the joint sealing member H2300 between them. Thus, the ink inlet port H1602 of the ink supply unit H1003 and the ink supply port H1201 of the recording element unit H1002 can be communicated in good condition without allowing ink to leak.

At this juncture, no adhesive agent is used around the connecting portion of the recording element unit H1002, the ink supply unit H1003, and the ink supply path. Consequently, there is no possibility that the connecting portion of the ink supply paths is clogged by adhesive agent or there is no fear at all that any defect, such as ink leakage, is encountered due to insufficient application of adhesive agent or due to bubble inclusion, insufficient bonding power, or the like. There is no need for considering the resultant defects in relation to the application of adhesive agent to make it possible to relatively simplify the coupling process for a highly reliable coupling at lower costs.

Also, when the recording element unit H1002 and the ink supply unit H1003 are coupled, tolerance is controlled to form the abutting portions to be provided for the abutting faces thereof. Then, the abutting portions are in contact to perform positioning. As a result, both of them can be positioned in good precision for coupling. Then, the recording head cartridge H1000 is positioned in high precision and mounted on the carriage of the main body with reference to the referential surface provided for the ink supply unit H1003. Consequently, the recording element base plates H1100 and H1101 provided for the recording element unit H1002 can be positioned in good precision and arranged for the carriage, hence making it possible to perform a high quality recording.

Also, the screw retaining portions H1206 are arranged in the outer positions across the plane where the electric wiring tape H1300 is provided. Therefore, it is made possible to press the electric wiring tape H1300 to be in contact for fixation without exerting any stress thereon.

(Embodiment 1-2)

Next, with reference to FIGS. 11A and 11B and FIGS. 12A and 12B, the description will be made of the embodiment 1-2 in accordance with the present invention. The present embodiment is the variational example of the screw retaining boss H1517 of the screw H2400 for coupling and fixing the recording element unit H1002 and ink supply unit H1003 provided for the recording head cartridge H1000 of the ink supply unit H1003 of the embodiment 1-1. FIGS. 11A and 11B and FIGS. 12A and 12B illustrate the flow path formation member H1600B which is the structural component of the ink supply unit H1003 of the recording head cartridge H1000 in order to represent the characteristics of the modified portion. Any other parts are the same as those of the embodiment 1-1, and the description thereof will be omitted.

Figure 11A:
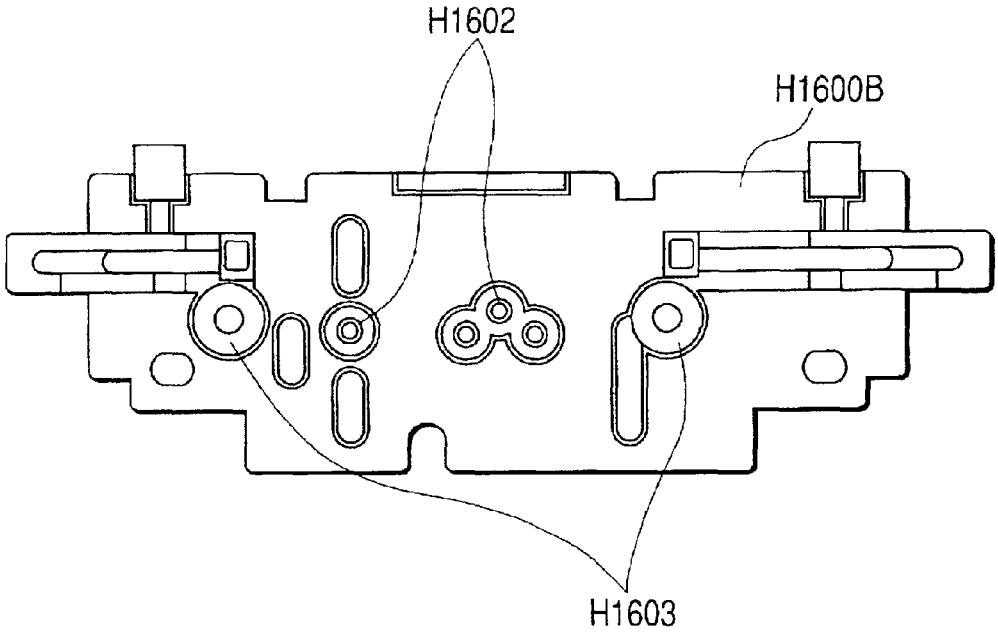
FIGS. 11A and 11B are views which illustrate the flow path formation member of a recording head cartridge in accordance with the embodiment 1-2 of the present invention.
Figure 11B:
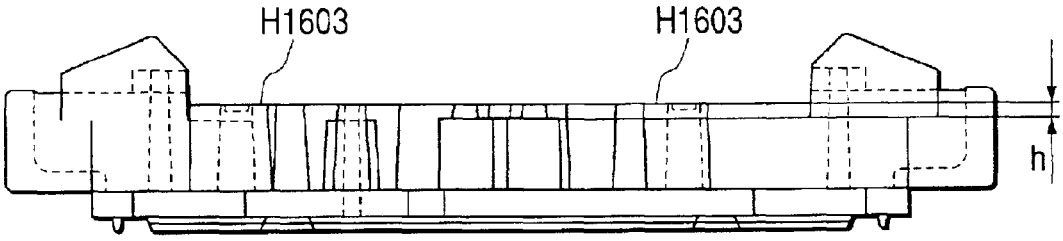

Whereas the screw retaining boss H1517 is provided for the ink supply member H1500 of the ink supply unit H1003 in the embodiment 1-1, the screw retaining boss H1603 is provided, as shown in FIGS. 11A and 11B, for the flow path formation member H1600B in the present embodiment.

Now, therefore, when the recording element unit H1002 is screwed to the ink supply unit H1003 for fixation, a part of the backside of the plane where the recording element base plates H1100 and H1101 of the first plate H1200 of the recording element unit H1002 are fixed is allowed to abut against the screw retaining boss H1603 which is provided for the ink flow path formation member H1600, and, at the same time, abut indirectly upon the portion where the ink inlet port H1602 is arranged with the joint rubber H2300 being placed between them.

With both the portion having the ink inlet port H1602 formed therefor, and the screw retaining boss H1603 being formed for the flow path formation member H1600B, the dimensional precision between them (dimension H) for the abutting plane thereof against the first plate H1200 can be made higher and more easily than that of the structure arranged for the embodiment 1-1. In other words, for the embodiment 1-1, the ink inlet port H1602 is arranged for the liquid flow path formation member H1600, and the screw retaining boss H1517 is arranged for the ink supply member H1500. As a result, the tolerance of the dimensional precision (dimension H) tends to become greater between the portion where the ink inlet port H1602 and the screw retaining bass H1517 eventually by the portion of the tolerance between the liquid flow path formation member H1600 and the ink supply member H1500 when welded by ultrasonic or the like.

Therefore, when the connection is made between the recording element unit H1002 and the ink flow path of the ink supply unit H1300 by pressing them with the joint sealing member H2300 being placed between them, it becomes possible to make the variation of the amount of pressurized contact smaller for the joint sealing member, and enhance the sealing performance for the ink supply path.

Figure 12A:
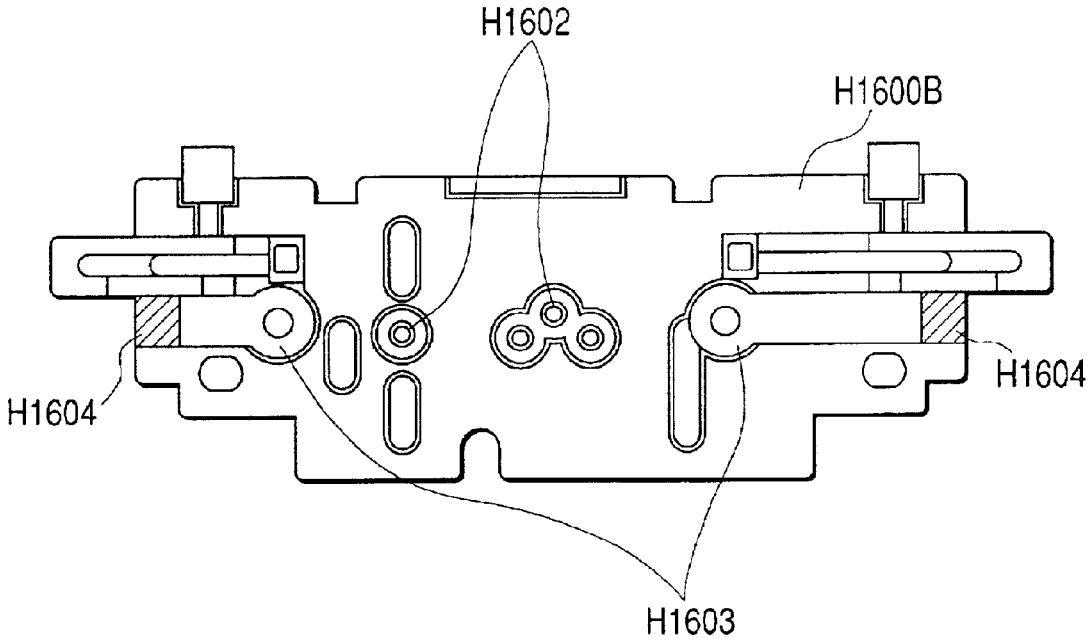
FIGS. 12A and 12B are views which illustrate the flow path formation member of a recording head cartridge in accordance with the variational example of the embodiment 1-2 of the present invention.
Figure 12B:
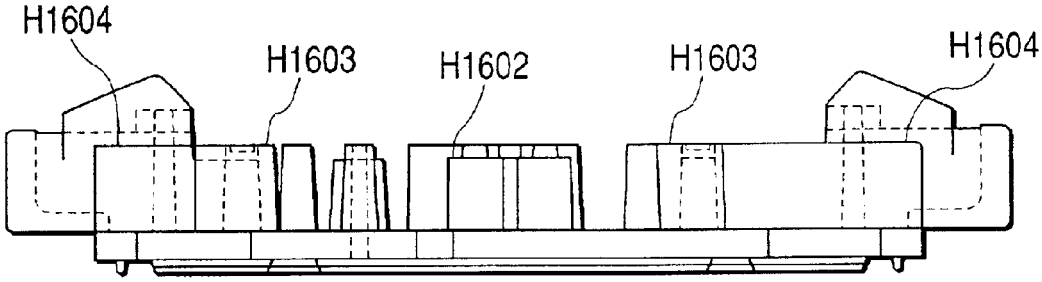

Further, as shown in FIGS. 12A and 12B, the referential surface H1604 in the direction Z (liquid discharging direction) of the recording head cartridge H1000 is provided on one and the same plane as the abutting face of the screw retaining boss H1603 arranged for the liquid flow path formation member H1600B against the first plate H1200. Therefore, the positional precision is enhanced for the recording element base plates H1100 and H1101 with respect to the referential surface H1604 in the direction Z of the recording head cartridge H1000 in the direction Z, hence making it possible to perform a high quality recording.

(Embodiment 1-3)

Figure 13:
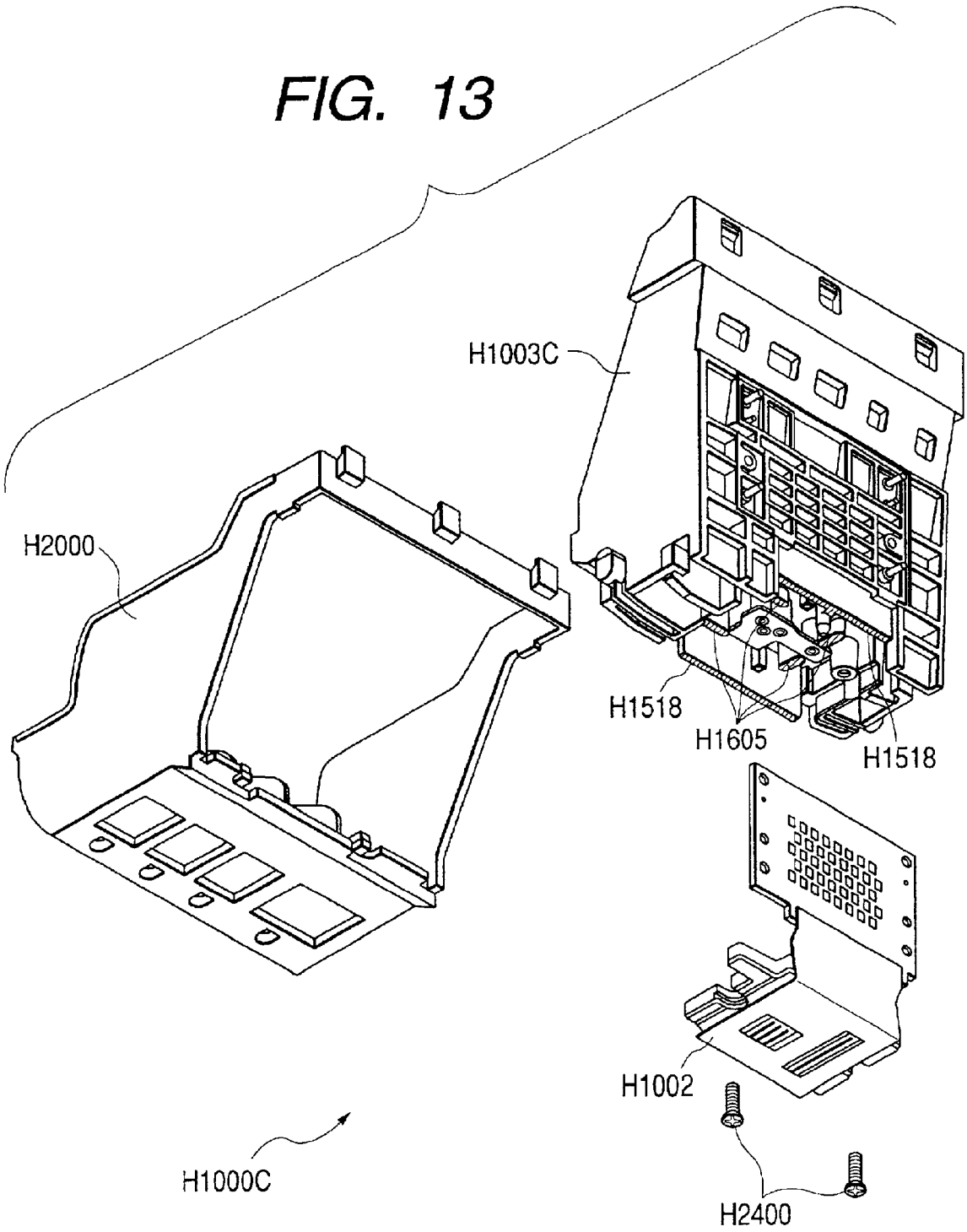
FIG. 13 is an exploded perspective view which shows a recording head cartridge in accordance with the embodiment 1-3 of the present invention.

Next, with reference to FIG. 13, the embodiment 1-3 will be described in accordance with the present invention. FIG. 13 is an exploded perspective view which shows a recording head cartridge H1000C of the present embodiment. In FIG. 13, the same reference marks are applied to the same parts as those appearing in the embodiment 1-1, and the description thereof will be omitted.

For the present embodiment, the recording element unit H1002 and the ink supply unit H1003C are fixed by the application of adhesive agent in addition to the use of the screws H2400. As shown in FIG. 13, for the ink supply unit H1003C of the present embodiment, an adhesive agent coating portion H1518 is formed for the ink supply member H1500, and also, an adhesive agent coating portion H1605 is formed for the liquid flow formation member H1600. The recording element unit H1002 and the ink supply unit H1003 are adhesively bonded by applying RTV silicone adhesive agent, the epoxy adhesive agent which is hardened at a normal temperature, the fluorine adhesive agent which is hardened at a normal temperature, or the like, for example, to the adhesive agent coating portions H1518 and H1600, and then, fixed by use of screws. Here, in accordance with the present embodiment, the adhesive agent is not applied to the circumference of the ink supply path. Thus, there is no possibility to hinder distributions in the ink supply path.

With this structure, the connection reliability becomes higher still between the recording element unit H1002 and the ink supply path of the ink supply unit H1003, while it becomes possible to prevent recording liquid from flowing into the fine gap between the first plate H1200 and the flow path formation member H1600. As a result, a recording medium is prevented from being stained by the accumulated recording liquid in this fine gap at the time of recording, which may fall off from the gap eventually.

For the present embodiment, the structure that holds a tank for the ink supply unit H1003 is shown, but the present invention is not necessarily limited to such structure. The ink supply unit may be structured with an ink retaining unit without holding any tank or with a tank arranged at a difference location to supply liquid therefrom by way of tubes.

<Second Embodiment>

The recording head H1001 will be described in detail. The recording head H1001 is the one which is called the side shooter type using bubble jet method whereby to record by use of electrothermal converting devices that generate thermal energy for creating film boiling in ink in accordance with electric signals.

Figure 14:
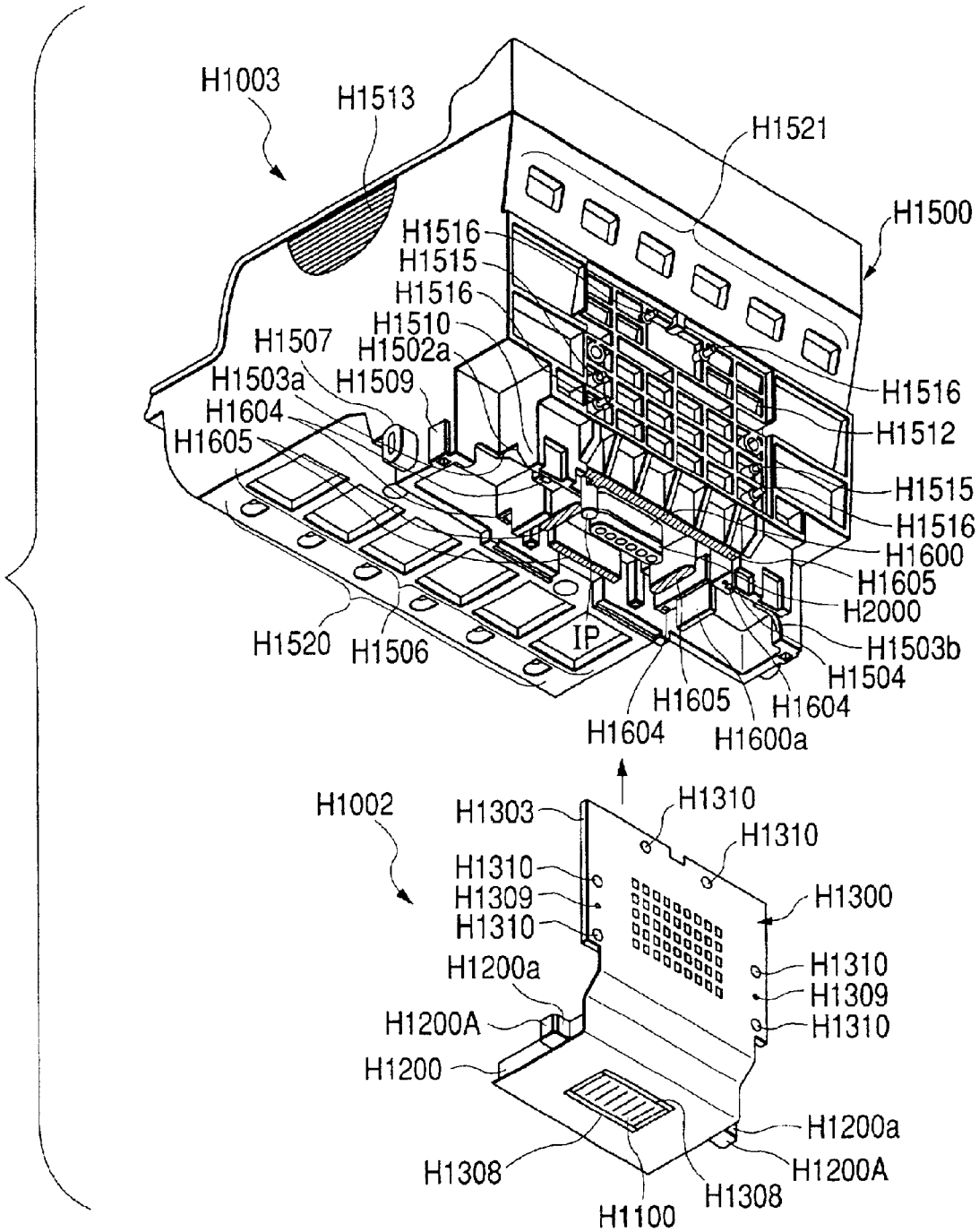
FIG. 14 is an exploded perspective view which shows one example of a liquid discharge head in accordance with another embodiment of the present invention.
Figure 15:
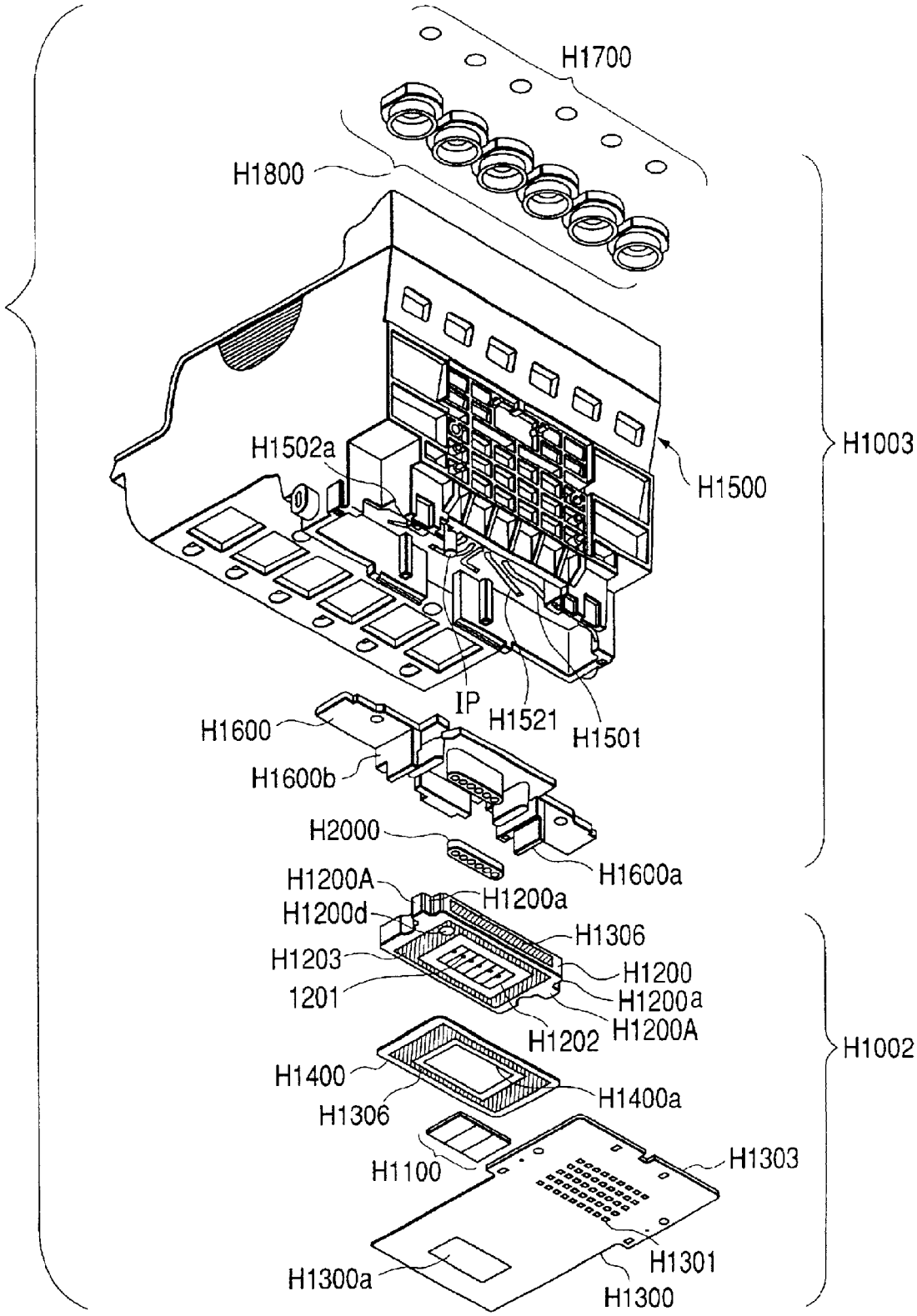
FIG. 15 is an exploded perspective view which shows the structure of the example represented in FIG. 14.

As shown in FIG. 14 which is an exploded perspective view, the recording head H1001 comprises a recording element unit H1002 and a tank holder unit H1003. Further, as shown in FIG. 15, which is also an exploded perspective view, the recording element unit H1002 comprises a recording element base plate H1100; a first plate H1200; an electric wiring base board H1300; and a second plate H1400. Also, the tank holder H1003 comprises a tank holder H1500; a flow path formation member H1600; a packing member H2000; six filters H1700; and six sealing rubbers H1800.

(Recording Element Unit)

The recording element base plate H1100 is of side shooter type, for example, which formed by one base plate. On the base plate, a plurality of discharge ports H1107 are arranged in two lines in the zigzag formation in terms of approximately 1200 dpi per ink color, for example, and are assumed to be able to discharge ink of different ink colors, respectively.

The recording element base plate H1100 comprises the Si base plate H1101 having thin film formed on the surface thereof, and an orifice plate H1112 formed on the base plate H1101.

The base plate H1101 is in a thickness of 0.5 to 1 (mm), for example, and formed integrally with the ink supply ports H1102 arranged in the six lines of the elongated and grooved through openings which are in parallel to each other as the six-color ink flow paths. The interrelated distance between adjacent ink supply ports H1102 is set at approximately 2.5 mm, for example. With such comparatively small interrelated distance as this, it is made possible to attempt miniaturization of the recording head. On the sides across each of the ink supply ports H1102, a plurality of electrothermal converting devices H1103 are formed and arranged as recording elements each in one line and in the zigzag formation in terms of approximately 1200 dpi per ink color, for example.

A plurality of electrothermal converting devices H1103 and the electric wiring, such as Al, to supply electric power to each of the electrothermal converting devices H1103 arranged on the base plate 1101 are formed by means of film formation technologies and techniques. Also, the electrode portion H1104 for supplying electric power to the electric wiring is formed along the edge portion in the direction orthogonal to the arrangement direction of the electrothermal converting devices H1103. The electrode portion H1104 is provided with a plurality of bumps H1105 of gold or the like each corresponding to each of the electrode terminals H1302 of the aforesaid electric wiring base board H1300. The ink supply ports H1102 are formed by means of anisotropic etching utilizing the crystal orientation of the Si base plate H1101, for example.

Also, for the orifice plate H1112 formed on the base plate H1101, ink flow path walls H1106 and discharge ports H1107 are formed by means of photo-lithographic techniques in order to form ink flow paths corresponding to the respective electrothermal converting devices H1103. As a result, the adjacent discharge ports H1107 are partitioned to each other by the presence of the ink flow path walls H1106 eventually.

The six-line discharge ports H1107, which correspond to each of six color ink to be supplied from each of the ink supply ports H1102, are formed integrally on one orifice plate H1112. A plurality of discharge port H1107 arrays are arranged in the zigzag formation as in the case of the arrangement of the electrothermal converting devices H1103, and formed in terms of approximately 1200 dpi per ink color, for example. In other words, the discharge ports H1107 are provided to face the electrothermal converting devices H1103, respectively.

The first plate H1200 shown in FIG. 15 is formed by alumina ($Al_2O_3$) material in a thickness of 0.5 to 10 mm, for example. In this respect, the material of the first plate is not necessarily limited to Alumina. It may be possible to produce the first plate H1200 with a material having the same linear expansion coefficient as that of the material used for the recording element base plate H1100, as well as the same thermal conductivity as that of the recording element base plate H1100, such as either one of silicon (Si), aluminum nitride (AlN), zirconium, silicon nitride ($Si_3N_4$), silicon carbide (SiC), molybdenum (Mo), and tungsten (W). For the first plate H1200, six ink supply ports H1201 are formed in order to supply ink of six colors to the recording element base plate H1100. The six ink supply ports H1201 of the recording element base plate H1100 are positioned corresponding to the six ink supply ports H1201 of the first plate H1200, respectively, and also, the recording element base plate H1100 is positioned to the first plate H1200 in good precision and adhesively fixed. The first adhesive agent H1202 used for this bonding is coated on the first plate H1200 substantially in the shape of the recording element base plate in such a manner so that no air passage is created between the adjacent ink supply ports. The first adhesive agent H1202 should preferably provide a comparatively low viscosity with thin adhesive layer to be formed on the contact face, and a comparatively high hardness after having been hardened, as well as resistance to ink. The first adhesive agent H1202 is a thermohardening adhesive agent having epoxy resin as the main component thereof, for example, and the thickness of the bonding layer should preferably be 50 $\mu$m or less.

The first plate H1200 is provided with extrusions H1200A on end portions across the plate, respectively. Each of the extrusions H1200A has an engaging face H1200*a* as the referential surface which engages with the referential end face portions H1502*a* and H1502*b* of the aforesaid tank holder H1500, respectively. The extrusion H1200A is arranged to protrude substantially perpendicular to the side face thereof, that is, to protrude in the direction in which the tank holder H1500 moves. Also, at the position corresponding to the positioning pin IP of the tank holder H1500, there is formed a through hole H1200*d* with which the leading end of the positioning pin IP engages.

As shown in FIG. 15, the electric wiring board H1300 is arranged to apply electric signals to the recording element base plate H1100 for discharging ink, and provided with an opening H1300*a* for incorporating the recording element base plate H1100; an electrode terminal H1302 that corresponds to the electrode portion H1104 of the recording element base plate H1100; and the external signal input terminal H1301 positioned in the wiring end portion to receive electric signals from the main body apparatus.

The opening portion H1300*a* of the electric wiring board H1300 corresponds to the recording element base plate H1100 arranged on the first plate H1200, and thee opening portion H1400*a* of the second plate H1400 as well. The electric wiring board H1300 and the recording element base plate H1100 are electrically connected. The connecting method thereof is, for example, such as to apply a thermohardening adhesive resin between the electrode portion H1104 of the recording element base plate H1100 and the electrode terminal H1302 of the electric wiring board H1300, and after that, harden the thermohardening adhesive resin by heating under pressure the electrode portion H1104 of the recording element base plate H1100 and the electrode terminal H1302 of the electric wiring board H1300 altogether by use of a heating tool, thus connecting the electrode portion H1104 and the electrode terminal H1302 altogether electrically. Here, also, this is equally applicable to the use of the anisotropic conductive adhesive agent that contains conductive particles as the thermohardening adhesive resin. In the structure of the present embodiment, the anisotropic conductive adhesive film, which is produced by the adhesive agent the main component of which are the conductive particles of nickel having single granular diameter of 26 $\mu$m and epoxy resin is used, for example, and then, the electrode portion H1104 of the recording element base plate H1100 and the gold-plated electrode terminal H1302 of the electric wiring board H1300 are heated at a temperature of 170 to 250° C. and bonded under pressure. These members are then electrically connected in good condition.

As the material of the electric wiring board H1300, a flexible wiring board with two-layer structured wiring formed therefor is used, the surface of which is covered by resist film, for example. Also, on the reverse side of the external signal input terminal H1301, a reinforcing plate H1303 is adhesively bonded to enhance the flatness of the external signal input terminal H1301. As the material of the reinforcing plate H1303, a heat-resistant material, such as glass epoxy resin or aluminum in a thickness of 0.5 to 2 mm, is usable, for example.

The second plate H1400 is formed by alumina ($Al_2O_3$) material in a thickness of 0.5 to 1 mm, for example. Here, however, the material of the second plate is not necessarily limited to alumina. It may be possible to produce this plate with a material having the same linear expansion coefficient as that of the recording element base plate H1100 and the first plate H1200, and the same heat conductivity as that of those plates or higher as well. Then, the second plate H1400 is configured to provide an opening larger than the outer dimension of the recording element base plate H1100 adhesively fixed to the first plate H1200. Also, in order to make electrical connection possible for the recording element base plate H1100 and the electric wiring base plate H1300 on the same plane, the second plate H1400 is adhesively bonded to the first plate H1200 by use of the second adhesive agent H1203. On the other hand, the backside of the electric wiring board H1300 is adhesively fixed to the second plate H1400 by use of the third adhesive agent H1306. Also, at the same time that the electric wiring board H1300 is adhesively bonded to the second plate H1400, this board is folded to one side face of the first plate H1200 and second plate H1400, and adhesively bonded to the side face of the first plate H1200 by use of the third adhesive agent H1306. For the second adhesive agent H1203, the one that provides a low viscosity, and a thin adhesive layer to be formed on the contact face, as well as resistance to ink, is used, for example. Also, for the third adhesive agent H1306, the thermohardening adhesive film, which is in a thickness of 10 to 100 $\mu$m with epoxy resin as the main component thereof, is used, for example.

As shown in FIG. 14, the electrically connecting portion, which is structured as described above between the recording element base plate H1100 of the recording element unit H1002 and the electric wiring board H1300, is sealed by a first sealant (not shown) and a second sealant H1308, thus protecting the electrically connecting portion from erosion due to ink and external shocks. The first sealant mainly seals the outer circumference of the recording element base plate H1100, and the second sealant seals the edge of the opening of the electric wiring board H1300. Also, the folded electric wiring board H1300 is further given a forming treatment along with the backside configuration of the tank holder H1500.

(Tank Holder Unit)

The tank holder H1500 is formed by means of resin molding, for example. For the resin material thereof, it is desirable to use a resin material having glass filler mixed in 5 to 40% in order to enhance the configuration robustness of the holder. As described above, the tank holder H1500 holds a freely detachable and attachable ink tank H1900, which is provided with the tank positioning pin for the ink tank H1900; the tank positioning holes H1520 to engage with a first nail, a second nail, and a third nail, respectively; a first hole (not shown), a second hole (not shown) and a third hole H1521; and an opening H1506 for the use of a prism to detect ink remainders as shown in FIG. 14.

Also, the tank holder H1500 is provided with the installing guide H1507 that guides the recording head cartridge H1000 to the installing position of the carriage M4001 of the ink jet recording apparatus main body, and the X abutting portion H1509, Y abutting portion H1510, and Z abutting portion H1511, which enable the recording head cartridge to be positioned by use of a head setting lever to the coupling portion for installing and fixing the cartridge, and also, to the designated installing position of the carriage. The tank holder H1500 is provided with the terminal fixing portion H1512 for positioning and fixing the external signal input terminal H1301 portion of the recording element unit H1002. On the terminal fixing portion H1512 and circumference thereof, there are arranged a plurality of ribs to enhance the robustness of the plane where the terminal fixing portion H1512 is provided. Also, between each of the cells where each of the ink tanks H1900 is installed, a rib H1516 is arranged to prevent each color from being mixed. Also, on the side face of the tank holder H1500, a hand holding portion H1513 is arranged to make it easier to handle the recording head H1001.

Also, the tank holder H1500 is one of the structural parts of the tank holder unit H1003 that forms the ink flow paths H1501 to induce ink from the ink tank H1900 to the recording element unit H1002. With the flow path formation member H1600 being welded to the tank older H1500 by means of ultrasonic welding, the ink flow paths H1501 are formed. Also, to the joint portion that engages with the ink tank H1900, the filters H1700 are bonded by means of thermal welding to prevent dust particles from entering from the outside. Further, the sealing rubber H1800 is installed to prevent ink from evaporating from the joint portion H1517. Each of the filters H1700 is provided with the SUS texture of hole diameter of 10 $\mu$m or less which is sintered to be a filter, for example, and formed in the dome shape to be fixed to the joint portion H1518. In this case, it is preferable to configure the filter to provide the maximum radial curvature at 0.1 to 0.5 (mm) approximately as the amount of extrusion of the dome shape.

With the filters H1700 thus installed, not only it becomes possible to effectively prevent external dust particles from entering, but also, to keep connections in a better condition between each of joint portions and the ink tank H1900.

In the tank holder H1500, on end of the portion where the flow path formation member H1600 is inserted is communicated with the aforesaid ink supply hole H1520, and each of the grooved ink flow paths H1521, which are formed corresponding to each opening end of the ink flow paths of the flow path formation member H1600, is formed on the other end thereof corresponding to each of the ink tanks H1900. Therefore, the other end of each of the ink flow paths H1521 is gathered corresponding to the opening end of each ink flow path of the flow path formation member H1600 so that the relative gap between the other end of each of the ink flow paths H1521 becomes smaller than the relative gap on one end. With the contact surface of the flow path formation member H1600 being bonded to the fixing portion of the tank holder H1500, each ink supply path is formed to supply each ink from each of the ink tanks H1900 to each of the ink flow paths of the flow path formation member H1600, respectively. Also, on the portion where the flow path formation member H1600 is inserted and fixed, the positioning pin IP is planted to engage with the flow path formation member H1600 and the first plate H1200.

Further, the tank holder H1500 is provided with the referential end faces H1502*a* and H1502*b* on the lower end of the backside thereof where the external signal input terminal H1301 is positioned and fixed. The referential end faces H1502*a* and H1502*b* are formed respectively on one and the same surface of the wall portions that form the circumferential edge of the portion where the flow path formation member H1600 is inserted and fixed. Consequently, the referential end faces H1502*a* and H1502*b* are provided on one and the same surface to make it easier to form them simultaneously at the time of forming process.

Also, the referential end faces H1502*a* and H1502*b* are communicated with the sidewise direction by way of the cut-off portions H1503*a* and H1503*b* formed on the circumferential edge of the portion where the flow path formation member H1600 is inserted and fixed, respectively. Further, on the central part of the wall portion where the referential end faces H1502*a* and H1502*b* are formed, a cut-off portion H1504 is formed to engage with the end portion of the first plate H1200.

On the side that faces the first plate H1200 which is combined through the packing member H2000, The flow path formation member H1600 is provided with the extruded pieces H1600*a* and H1600*b* that pinch the end portions across the first plate H1200.

At this juncture, between the extruded pieces H1600*a* and H1600*b* fixed to the tank holder H1500, and the referential end faces H1502*a* and H1502*b* of the tank holder H1500, there are formed eventually designated gaps with which the extrusions H1200A of the first plate H1200 are allowed to engage, respectively.

Figure 17:
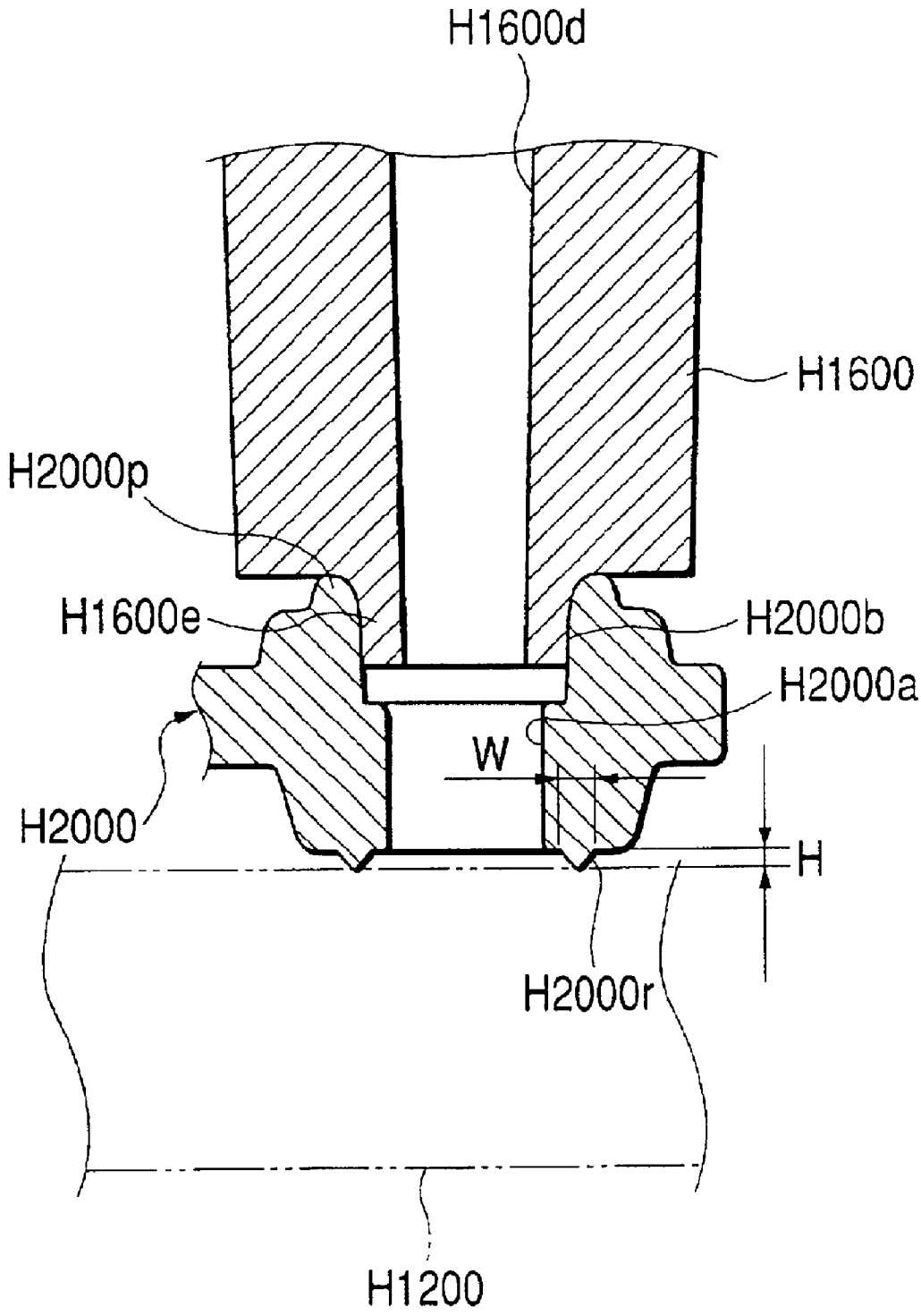
FIG. 17 is a cross-sectional view which shows the packing member arranged between the flow path formation member and a first plate for the example represented in FIG. 14.
Figure 18A:
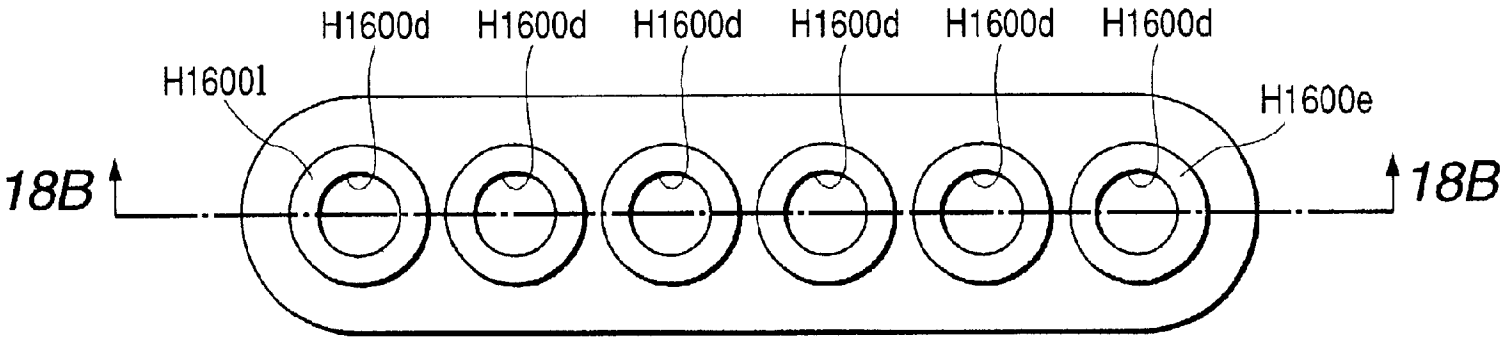
FIG. 18A is a plan views which shows the communication passage of the flow path formation member for the example represented in FIG. 14.
Figure 18B:
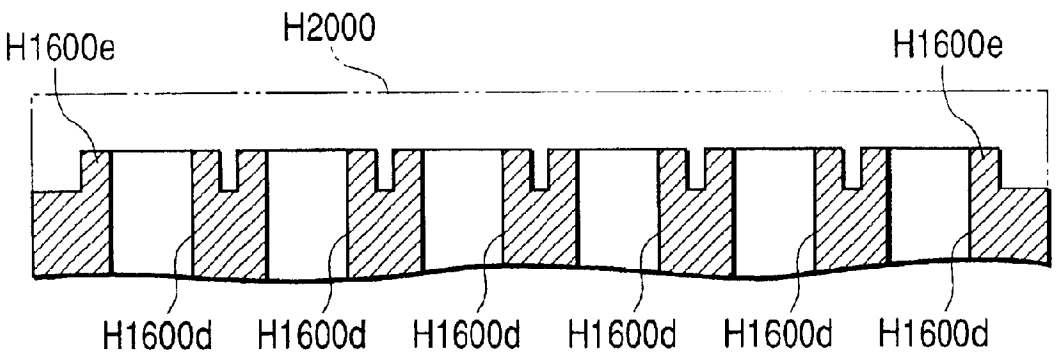
FIG. 18B is a partially broken sectional view which shows the portion indicated in FIG. 18A.

Also, as shown in FIG. 17 and FIGS. 18A and 18B, there are formed between the extruded piece H1600*a* and extruded piece H1600*b* which face each other, the ink flow paths H2000*a* and H2000*b* of the packing member H2000, and the communicating holes H1600*d* which are arranged in parallel to each other with a designated gap on a straight line corresponding to each end portion of the ink flow paths H1521, respectively. On the circumferential edge of the opening end of each communicating hole H1600*d* on the side where the packing member H2000 is in contact without adhesive agent, each of the circular edges H1600*e* is formed to be extruded form the other portions, respectively. When each of the edges H1600*e* engages with the packing member H2000, it is assumed to be coupled with each of the ink flow paths H2000*b* of the packing member H2000. In other words, each of the communicating holes H1600*d* is communicated with the interior of the first plate H1200 through the packing member H2000.

The packing member H2000 is produced with rubber martial, such as a chlorinated butyl rubber having low gas permeability, to make it at a hardness (JIS K6301 A scale) of 40° or more and 50° or less.

In the case of this example, the packing member H2000 is produced with chlorinated butyl rubber having a hardness of 45° in a thickness of approximately 2.5 mm. The packing member H2000 is assumed to be displaced as shown in FIG. 19, for example, when a designated compression force acts in the axial direction.

Figure 19:
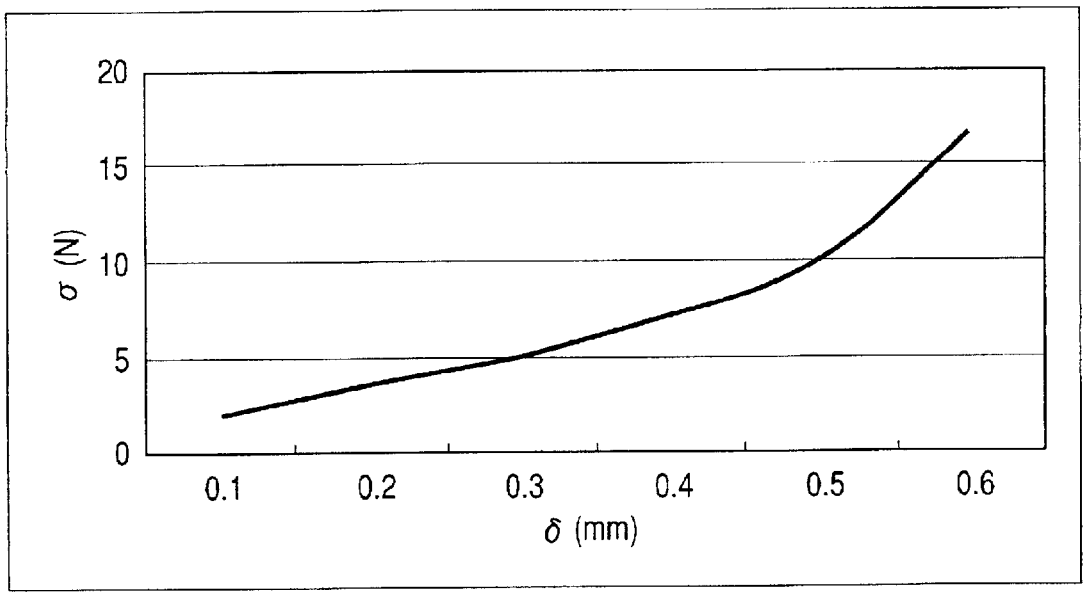
FIG. 19 is a view which shows the characteristics of the packing member represented in FIG. 17.

FIG. 19 shows the characteristics of the repellent force $\sigma$ corresponding to the amount of compression $\delta$ where the repellent force $\sigma$ (N) is given on the axis of ordinate, and the amount of compression $\delta$ (mm) on the axis of abscissa. As the repellent force $\sigma$ increases at a designated gradient in proportion to the increase of the amount of compression $\delta$, and when the repellent force $\delta$ exceeds 10 (N) and the amount of compression $\delta$ 0.5 mm, it is assumed that the repellent force $\sigma$ increases at a gradient greater still corresponding to the increased amount of compression $\delta$. When setting the contact pressure of the packing member H2000 that acts between the flow path formation member H1600 and the first plate H1200, the close contactness is determined after having verified it between the aforesaid chrolinated butyl rubber having a hardness of 45°, the first plate H1200, and the flow path formation member H1600.

In this respect, the method of verification is such as to confirm the relative contactness between the packing member H2000 and the recording head cartridge H1000 by the leakage test using a suction operation at a designated negative pressure and eye-sight after these members are incorporated as the structural parts thereof. For the adhesive agent applied to the designated locations of the flow path formation member H1600 shown in FIG. 14, an epoxy adhesive agent (product name: HP-2R/2H manufactured by Canon Chemical Co., Ltd.) is used. As a result, it is ascertained that within a range of contact pressure (repellent force σ) being 5 (N) to 10(N), there is no problem as to the adhesive contactness and leakage test of the packing member H2000 the characteristics of which are represented in FIG. 19.

Also, when the surface treatment is given to the contacting location as described later, the enhancement of adhesive power of each adhesive agent is confirmed to be described later. It is possible to perform the adhesive bonding even when the repellent force σ of the packing member H2000 is 30 (N).

This is because the elastic force that acts on the direction in which the first plate member H1200 is pulled away from the flow path formation member H1600, and the elastic force of the electric wiring board H1300 that acts also on one and the same direction are summed up to become smaller than the adhesive power of the adhesive agent.

Therefore, the repellent force a of the packing member H2000 is set at 5 (N) or more and 30 (N) or less. More preferably, it is set within a range of 5 (N) or more and 10 (N) or less.

For the present embodiment, the amount of compression δ of the packing member H2000 is set to be 0.3 mm or more and 0.5 mm or less in order to enable the contact pressure (repellent force σ) of the packing member H2000 to act preferably when the packing member is arranged between the liquid flow path formation member H1600 and the first plate H1200.

Consequently, as obvious from FIG. 19, the repellent force of 5 (N) or more and 10 (N) or less can act by means of the packing member H2000 between the flow path formation member H1600 and the first plate H1200.

The packing member H2000 is provided with six ink flow paths H2000*b* each fitted into each edge H1600*e* of the flow path formation member H1600. Also, each ink flow path H2000*b* is continuously communicated with the ink flow path H2000*a* having the inner diameter smaller than that thereof. On the circumferential edge of the opening end portion of the ink flow path H2000*b*, a ring type lip portion H2000*p* is formed to be in contact with the flat surface that forms the circumference of each edge H1600*e* of the flow path formation member H1600. On the other hand, on the circumferential edge of the opening end of the ink flow path H2000*a* a ring type lip portion H2000*r* is formed to be in contact with the surface of the first plate H1200. As a result, the packing member H2000 is in contact with the surface of the first plate H1200 only through the rib portion H2000*r*.

The rib portion H2000*r* has a triangular sectional configuration of width W and height H being 0.3 mm and 0.15 mm, respectively, for example.

(Coupling of Recording Heat Unit and Tank Holder Unit)

Figure 16:
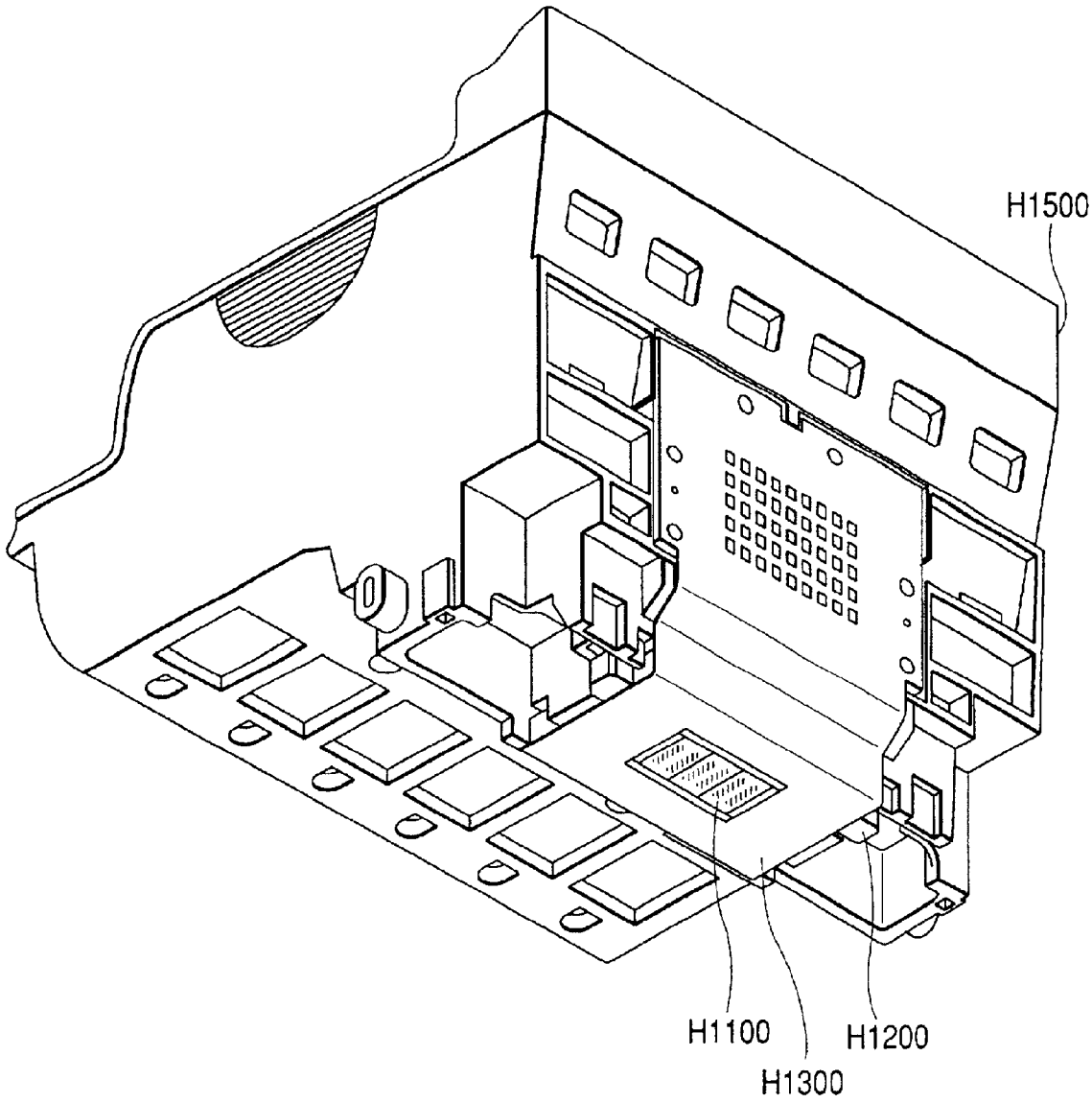
FIG. 16 is a perspective view which shows the state where the tank holder unit and the recording element unit are coupled for the example represented in FIG. 14.

As describe earlier, the recording head H1001 is completed when the recording element unit H1002 is coupled with the tank holder H1003 as shown in FIG. 16. This coupling is conducted as follows:

In order to enable the ink supply port (ink supply port H1201 of the first plate H1200) of the recording element unit H1002 to be communicated with the ink supply port (ink supply port of the flow path formation member H1600) of the tank holder unit H1003 through the packing member H2000, a seventh adhesive agent H1605 is applied to a plurality of locations of the flow path formation member H1600 as shown in FIG. 14. Then, the first plate H1200 and the flow path formation member H1600 are adhesively fixed. For the seventh adhesive agent H1605, the aforesaid epoxy adhesive agent (produce name: HP-2R/2H manufactured by Canon Chemical Co., Ltd.) is used, for example. The adhesive power of the seventh adhesive agent H1605 is assumed to be 30 (N) or more, for example.

Therefore, as described above, the repellent force of the packing member H2000 is set at 5 N or more and 10 N or less, while the elastic force of the electric wiring board H1300, which acts also on one and the same direction, is set at approximately 15 (N) to make it possible to adhesively bond the first plate H1200 and the flow path formation member H1600 reliably by use of the seventh adhesive agent H1605.

Also, when the recording element unit H1002 is adhesively bonded to the tank holder nit H1003 by the application of the seventh adhesive agent H1605, the recording element unit H1002 is positioned and provisionally fixed by use of the sixth adhesive agent H1604 which is applied to the designated locations of the flow path formation member H1600 as shown in FIG. 14. The sixth adhesive agent H1604 should desirably be hardened instantaneously. For the present embodiment, a ultraviolet hardening adhesive agent is used, for example, but other adhesive agent may be usable.

For the seventh adhesive agent H1605, any one of the adhesive agents may be usable if only the agent is flexible in withstanding the linear expansion between different kinds of materials, while having resistance to ink, and being hardened at a normal temperature.

The external signal input terminal H1301 portion of the recording element unit H1002 is positioned and fixed on one side face of the tank holder H1500 by use of the terminal positioning pins H1515 (two locations) and the terminal positioning holes H1309 (two locations). The fixing method is that, for example, the terminal coupling pins H1516 (six locations) arranged for the tank holder H1500 are fitted into the terminal coupling holes H1310 (six locations) arranged for the circumference of the external signal input terminal H1301 of the electric wiring board H1300. Then, the terminal coupling pins H1516 are thermally welded for fixation. Any other fixing means may be adoptable.

At this juncture, the adhesive power of the sixth adhesive agent H1604 is set at approximately 20 (N) which is smaller than the adhesive power of the seventh adhesive agent H1605. Therefore, the holding member H2100 which is a plate spring shown in FIG. 20 is held against the flow path formation member H1600 of the first plate H1200 for a designated time, approximately 12 hours, for example.

Figure 20:
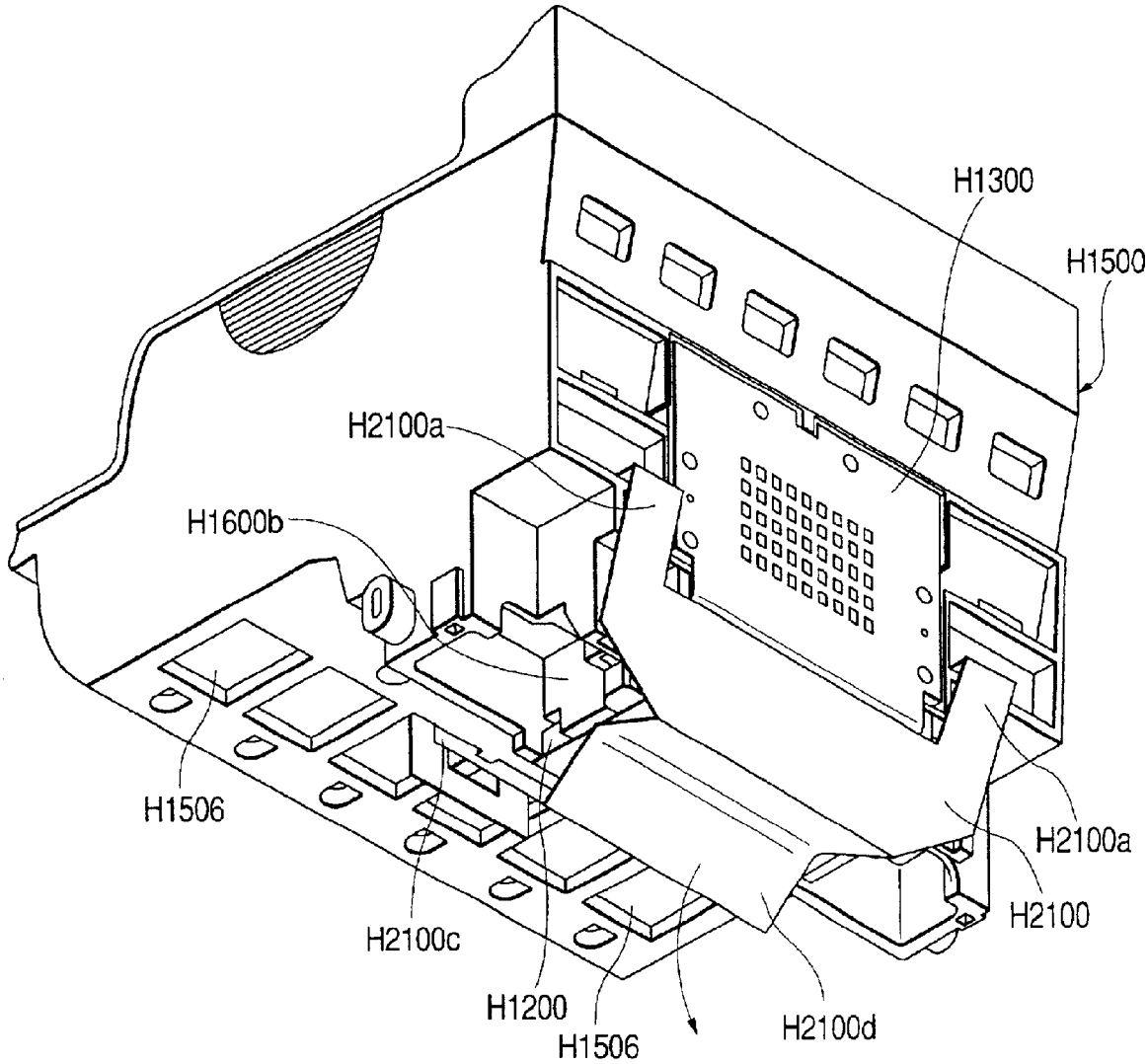
FIG. 20 is a perspective view which shows a holding member used for the example represented in FIG. 14, together with the tank holder unit and the recording element unit.

As shown in FIG. 20, the holding member H2100 is formed by the forked first coupling portion H1200*a* which engages with both sides of the electric wiring board H1300 fixed to the tank holder H1500; the second coupling portion H2100*c* which is inserted into adjacent two openings H1506 almost on the central portion of the tank holder H1500; and the compressing portion H2100*d* which connects the first coupling portion H1200*a* and the second coupling portion H2100*c*, and also, formed by the compressing portion H2100*d* that compresses the circumference of the recording element H1100 on the electric wiring board H1300.

The holding member H2100 maintains the first plate H1200 in a state of being adhesively bonded to the first palate H1200 in the direction in which it is pulled away from the flow path formation member H1600, that is, against the biasing force which acts in the direction indicated by an arrow. The holding member H2100 is assumed to maintain the first plate H1200 in the adhesively bonded condition if the biasing force is in a range of approximately 50 or more and 100 (N) or less.

Therefore, when the recording element unit H1002 is coupled with the tank holder unit H1003, the ink supply port (the ink supply port H1201 of the first plate H1200) of the recording element unit H1002, and the ink supply port (ink supply port of the flow path formation member H1600) of the tank holder unit H1003 are coupled through the packing member H2000 without adhesive agent. Consequently, there is no need for controlling the coating amount thereof or any other quality control of the kind, hence making it easier to assemble the recording head quickly.

For the embodiment described above, it may be possible to perform a reforming process with respect to each of the contacted faces before each of the contacting faces of the tank holder H1500 is allowed to be engaged. As the reforming, it is desirable to give oxygen plasma or corona discharge treatment. For the present embodiment, the treatment is given by use of a high-frequency corona surface treatment apparatus (AGI-02S, 300W manufactured by Kasuga Denki K. K.) for a period of approximately 30 seconds. The corona discharge treatment is such as to enable the electron generated by the application of high frequency high voltage between the electrodes set in the air to collide with the surface of a work arranged between the electrodes in order to create active radical on the surface thereof for the enhancement of adhesive power.

In this way, the adhesive power of the sixth adhesive agent H1604 is enhanced to approximately 50 (N), and that of the seventh one H1605 to approximately 200 (N). Therefore, with the execution of the reforming process such as this, the aforesaid holding member H2100 is no longer needed with the result that a large-scale productivity is eventually improved in the manufacture.

<Third Embodiment>

(Embodiment 3-1)

Figure 21:
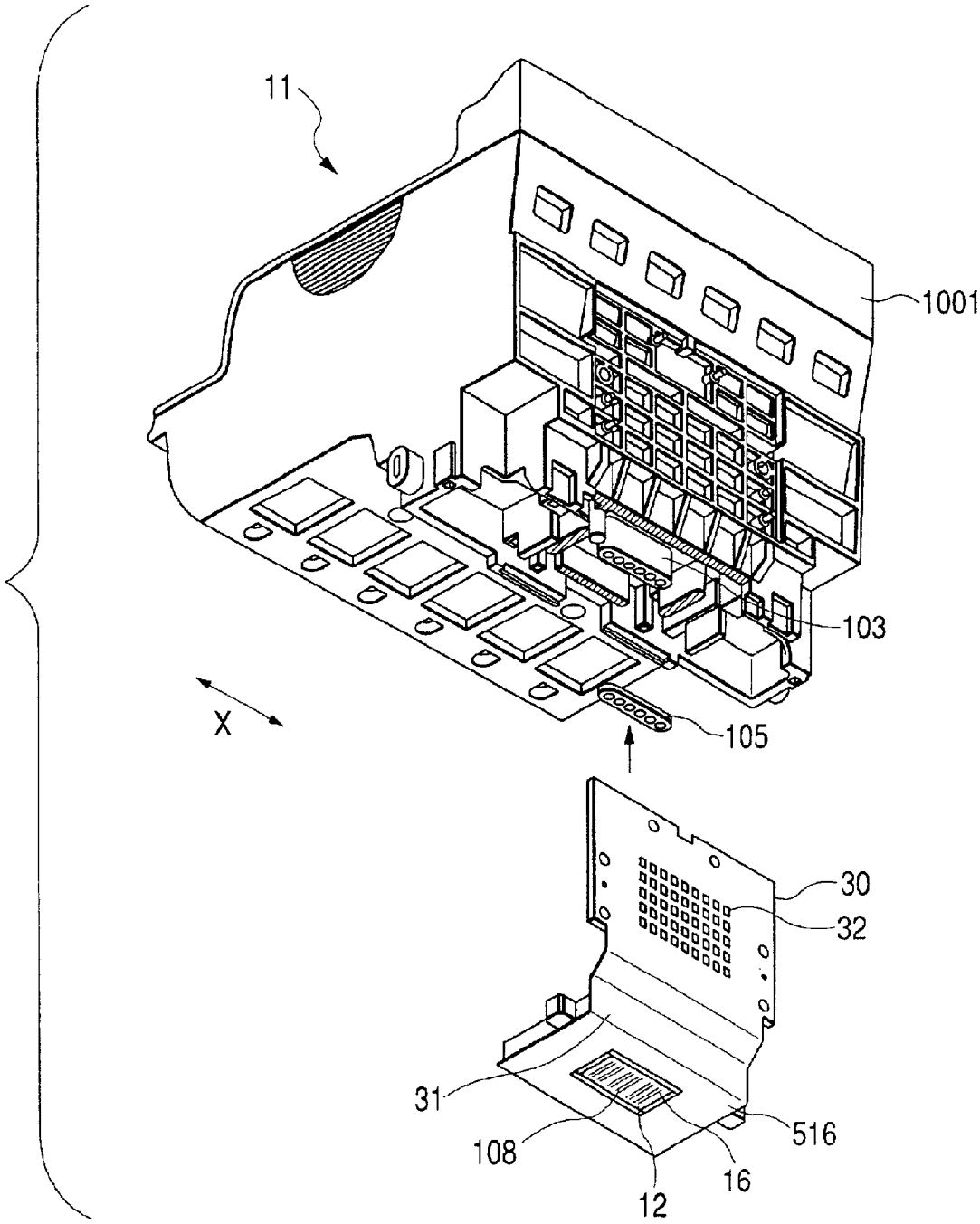
FIG. 21 is an exploded perspective view which shows one example of a recording head cartridge in accordance with another embodiment of the present invention.
Figure 22:
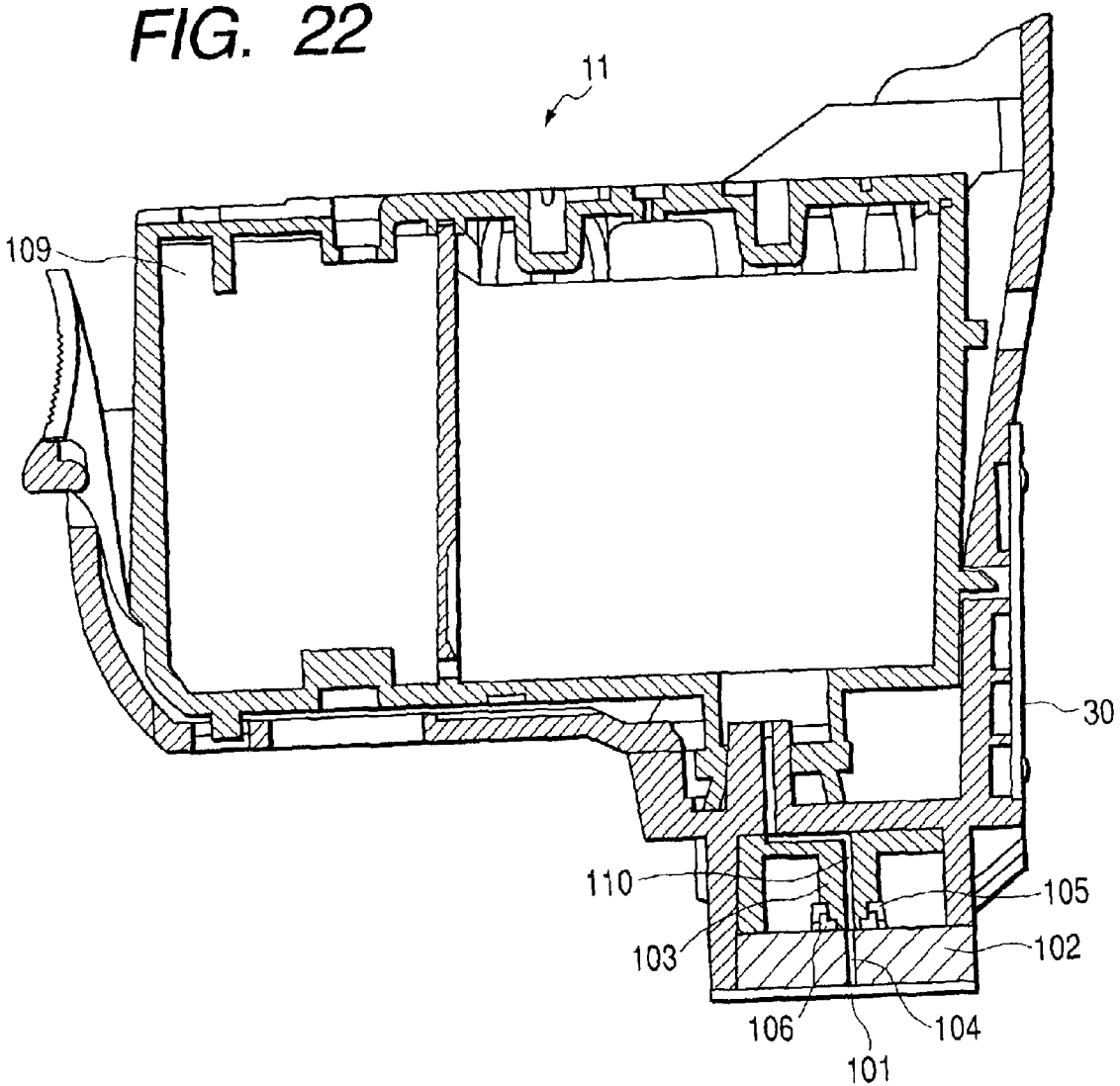
FIG. 22 is a side sectional view which shows the recording head cartridge represented in FIG. 21 in a state where an ink tank is installed.

FIG. 21 is an exploded perspective view which shows a recording head cartridge in accordance with the present embodiment. FIG. 22 is a side sectional view which shows the recording head cartridge of the present embodiment in a state where an ink tank is installed.

As shown in FIG. 21, the recording head cartridge 11, which is detachably mounted on the carriage of an ink jet recording apparatus (not shown) to reciprocate for scanning in the direction X, is provided with an ink jet recording head 516 comprising the first base plate 101 where an ink discharge port array 108 is formed with a plurality of discharge ports 16 for discharging ink, and a recording element base plate 12 formed by the second base plate 102. Also, the holder portion 1001 of the recording head cartridge 11 installs detachably an ink tank 109 for supplying ink to the recording element base plate 12. For the present embodiment, the recording head cartridge 11 is shown as an example, which is made capable of mounting six ink tanks 109 containing ink of six colors. The six ink colors contained in the ink tank 109 may be black ink, and color ink of other colors than black.

An electric wiring tape 31 is the one whereby to apply electric signals to the first base plate 101 for discharging ink, which comprises an opening to incorporate the first base plate 101; the electrode terminal which is used for an element base plate corresponding to the electrode portion of the first base plate 101; and the electrode terminal which is positioned on the end portion of the electric wiring tape 31 and used for the contact base plate in order to make electrical connection with the electric contact base plate 30 provided with the external signal input terminal 32 to receive electric signals from an ink jet recording apparatus. The electrode terminal for use of the contact base plate and the electrode terminal for use of the element base plate are connected by use of a continuous copper foil wiring pattern (not shown).

For the first base plate 101, the electrothermal converting element layer, wiring, and others are usually patterned on a silicon wafer by means of photolithographic techniques, and nozzle walls and discharge ports 16 are formed by photosensitive resin. Thus, by means of anisotropic etching, the recording liquid supply ports are formed, and the outer shape is formed by cutting.

For the first base plate 101 and the electric wiring tape 31, the electrode portion of the first base plate 101 and the electrode portion of the electric wiring tape 31 are heated under pressure by a heating tool altogether after a thermohardening adhesive resin has been applied. Thus, the thermohardening adhesive resin is hardened to make electrical connection altogether.

The second base plate 102 is formed by alumina material in a thickness of 0.5 to 1.0 mm, for example. In this respect, the material of the second base plate 102 is not necessarily limited to alumina. It may be possible to form this base plate with the material which provides the heat conductivity equal to or more than the heat conductivity of the material used for the first base plate 101.

Also, for the second base plate 102, there are formed six ink supply paths 104 to supply ink of six colors to the first base plate 101. The six ink supply ports (not shown) of the first base plate 101 are made communicative with each of ink supply paths 104 when the first base plate 101 is positioned to the second base plate 102 in good precision and adhesively fixed thereto. The adhesive agent used for this adhesive bonding is the thermohardening adhesive agent having epoxy resin as the main component thereof, for example, and applied onto the second base plate 102 in the form of electrothermal converting elements, but without creating air passage between the adjacent ink supply paths.

The one end of the flow path formation member 103 is communicated with each of the six ink tanks 109, respectively, and the other end thereof has the six flow paths 110 which are communicated with the ink supply path 104 of the second base plate 102.

Figure 23:
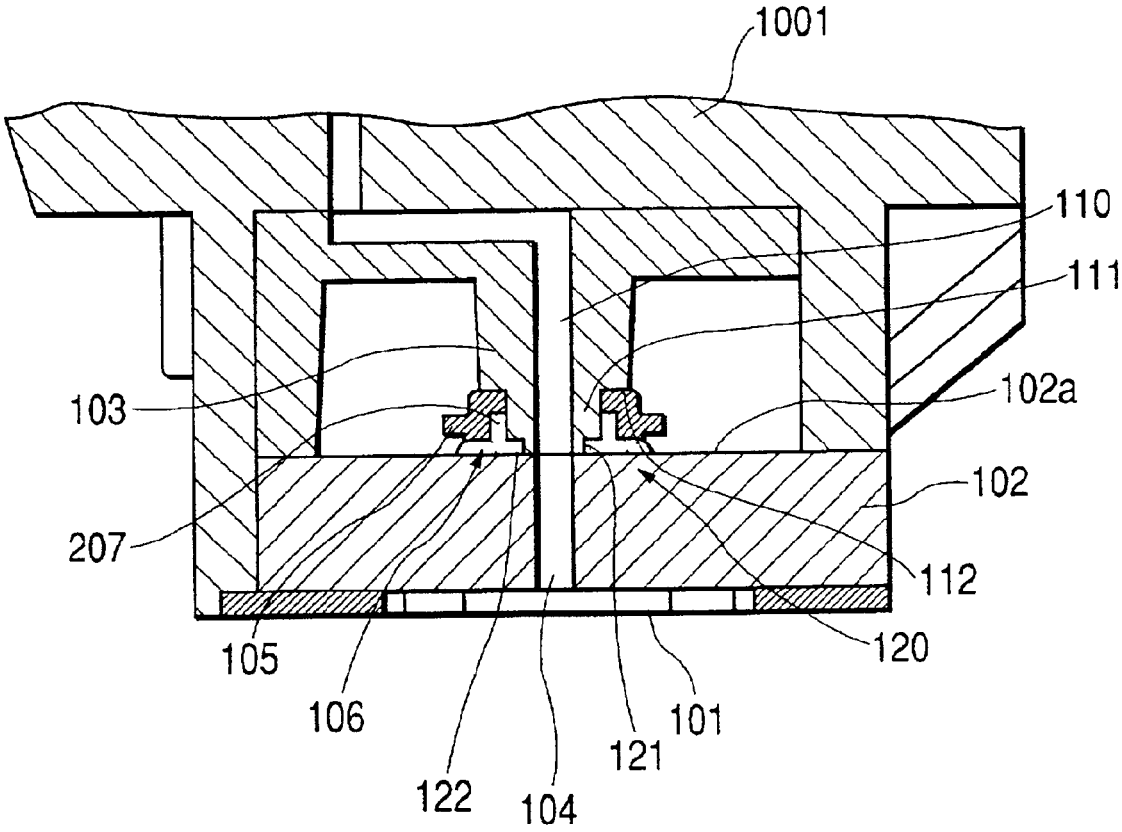
FIG. 23 is an enlarged side sectional view which shows the coupling portion between the flow path formation member and a second base plate.

The elastic member 105 is provided for the coupling portion 120 of the second base plate 102 and the flow path formation member 103 as shown in FIG. 23.

The adhesive agent 106 is filled in the space 207 which is formed by the elastic member 105, the second base plate 102, and the outer circumference 121 of the flow path formation member 103 so as to seal the contact portion 122 between the second base plate 102 and the outer circumference 121 of the flow path formation member 103.

The six flow paths 110 formed for the flow path formation member 103 by use of the elastic member 105 and the adhesive agent 106, and the ink supply paths 104 formed for the second base plate 102 are communicated with each other in a state of being sealed against the outside.

The holder portion 1001 is formed by resin molding, for example. For the resin material, it is desirable to use the one in which glass filler is mixed by 5 to 40% in order to enhance the shaping robustness. For the flow path formation member 103, it is also desirable to use the same material as that one used for the holder portion 1001. The flow path formation member 103 is bonded to the holder portion 1001 by use of ultrasonic welding.

Figure 24A:
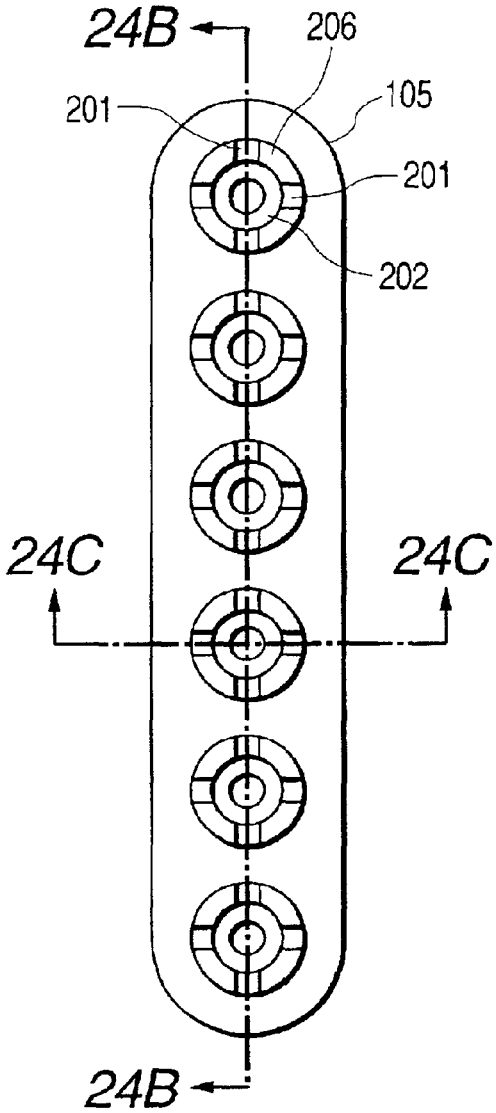
FIG. 24A is a plan view which shows an elastic member in accordance with another embodiment of the present invention.
Figure 24B:
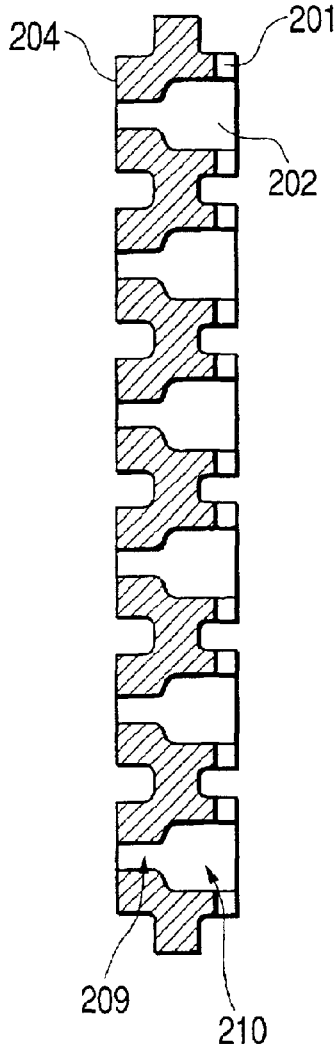
FIG. 24B is a linearly sectional view taken along line 24B—24B in FIG. 24A.
Figure 24C:
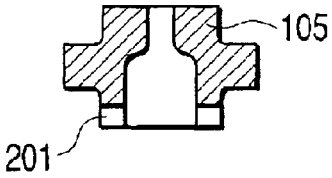
FIG. 24C is a linearly sectional view taken along line 24C—24C in FIG. 24A.

FIGS. 24A to 24C are views which illustrate the elastic member of the present embodiment. FIG. 24A shows the upper face of the second base plate, observed from the close contact surface side. FIG. 24B is a cross-sectional view taken along line 24B—24B in FIG. 24A. FIG. 24C is a cross-sectional view taken along line 24C—24C in FIG. 24A.

For the elastic member 105, there are formed six holes 202 individually corresponding to six flow paths 110 and ink supply paths 104. Each hole 202 is formed by a smaller diameter portion 209 for use of positioning with respect to the extrusion 111 of the flow path formation member 103, and a larger diameter portion 210 having a larger inner diameter than the smaller diameter portion 209 with cut-off portions 201 formed on all sides serving as filling ports of adhesive agent 106 in order to provide a space 207 to be described later.

The material of the elastic member 105 should preferably provide a certain robustness, although resistance to ink is not required. It is preferable to use the one which enables the flow path formation member 103 and the elastic member 105 to be closely in contact completely, and further, which does not allow the cut-off portions 201 to be deformed when the second base plate 102 and the flow path formation member 103 are coupled.

Figure 25:
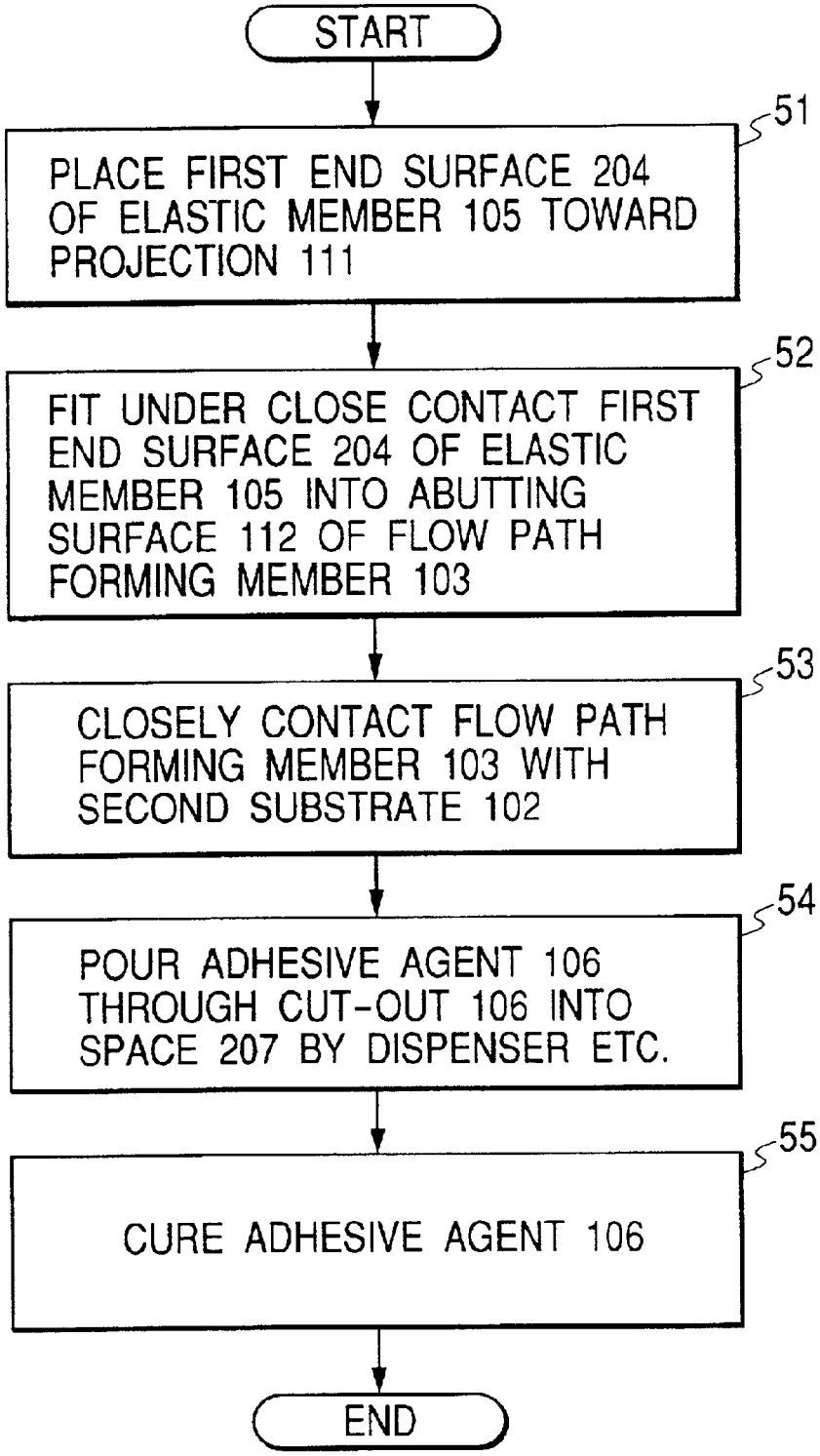
FIG. 25 is a flowchart which illustrates the coupling process of the second base plate and the flow path formation member.

Next, in conjunction with a flowchart shown in FIG. 25, the description will be made of the coupling of an ink jet recording head 516 and a holder portion 1001, that is, the coupling of the second base plate 102 and the flow path formation member 103.

At first, the elastic member 105 is arranged with the first end face 204 side thereof, which is the end face of the smaller diameter portion 209, being placed corresponding to the six independent extrusions 111 which form each of the flow paths 110 of the flow path formation member 103 (step 51).

Next, the elastic member 105 is fitted into the extrusions 111 of the flow path formation member 103 from the first end face 204 side so that the first end face 204 of the elastic member 105 is closely in contact with the abutting surface 112 of the flow path formation member 103 (step 52).

Next, the flow path formation member 103 and the second base plate 102 are put closely in contact (step 53). At this juncture, the flow path formation member 103 and the second end face 206, which is the end face of the larger diameter portion 210 of the elastic member 105, are kept firmly in close contact with the second base plate 102.

Figure 26:
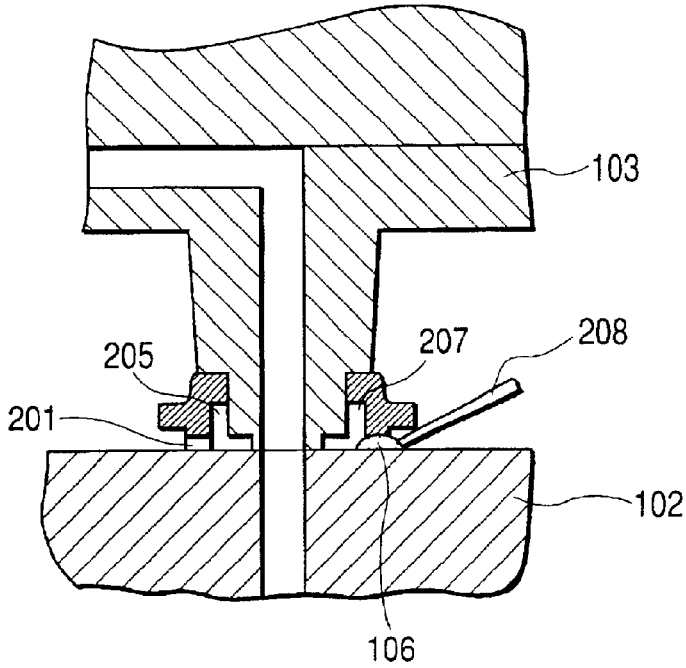
FIG. 26 is a view which illustrates the injection method of adhesive agent by use of a dispenser.

Next, from the cut-off portions 201, adhesive agent 106 is poured by use of a dispenser 208 or the like into the space 207 created between the elastic member 105, the flow path formation member 103, and the second base plate 102 as shown in FIG. 26 (step 54). After that, the adhesive agent 106 is hardened (step 55). The adhesive agent 106 should preferably be provided with resistance to ink, and the capability to be hardened at a normal temperature, but with flexibility in withstanding the difference of linear expansions between different kinds of materials. It is preferable to use silicone adhesive agent of hygroscopic hardening type or the like, for example.

Ink is supplied from the ink tank 109 to the first base plate 101 having ink grooves (not shown) thereon corresponding to the electrothermal converting devices formed through the flow paths 110 formed for the flow path formation member 103, and the ink supply paths 104 formed for the second base plate 102.

The ink jet recording head structured as described above performs an image formation by the adhesion of ink which has been discharge onto a recording medium (not shown) in such a manner that when electric energy is inputted into each of the electrothermal converting devices formed on the first base plate 101 from an ink jet recording apparatus through the electric wiring tape 31, the ink, which is in contact with each of the electrothermal converting devices, is caused to change the states thereof along with an acute voluminal change (generation of bubble), and then, by means of acting force based on the change of states of liquid, ink is discharged from each of the discharge ports 16.

As described above, the ink jet recording head of the present embodiment is structured so that only the adhesive agent 106 with resistance to ink is possibly in contact with ink directly, but the elastic member 105 is not in contact with ink. In this way, it becomes possible to suppress the defects that may take place in discharging ink due to dust particles or impurities adhering to the elastic member 105, or the elution of rubber. Also, the flow paths 110 and ink supply paths 104 are communicated with the highly intensified close contact by use of the adhesive agent 106 and the elastic member 105, thus making it possible to prevent the air from being mixed in the ink supply flow paths.

(Embodiment 3-2)

Figure 27A:
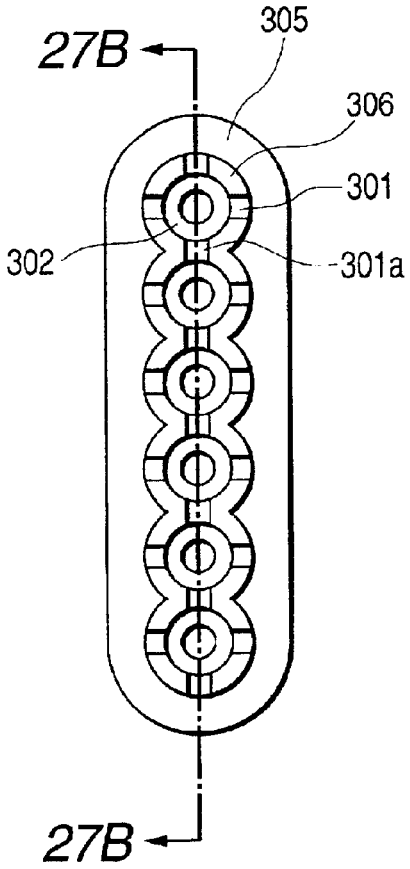
FIG. 27A is a plan view which shows an elastic member in accordance with another embodiment of the present invention.
Figure 27B:
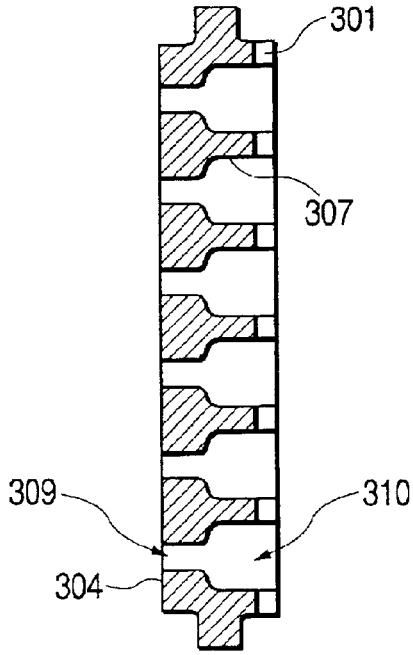
FIG. 27B is a linearly sectional view taken along line 27B—27B in FIG. 27A.

Now, FIG. 27A shows the upper view of an elastic member of the present embodiment. FIG. 27B is a cross-sectional view taken along line 27B—27B in FIG. 27A.

In this respect, the structure of an ink jet recording head, to which the elastic member of the present embodiment is installed, is fundamentally the same as that of the ink jet recording head described for the embodiment 3-1 with the exception of the pitches of each ink supply paths which are arranged to be narrower. Therefore, in the description of the present embodiment, the reference marks used for the embodiment 3-1 are used with the exception of those related to the elastic member 305.

As in the elastic member 105 of the embodiment 3-1, the elastic member 305 of the present embodiment is formed with the smaller diameter portions 309 for positioning with respect to the extrusions 111 of the flow path formation member 103, and the larger diameter portions 310 with cut-off portions 301 for injecting adhesive agent, which form a space capable of filling in the adhesive agent, respectively.

Meanwhile, the wall faces of adjacent holes themselves, among the wall faces that constitute each of the holes 302 of the elastic member 305 of the present embodiment, are formed by a common wall 307 integrated without being independent to each other in order to enable them to meet the narrower pitches along with the miniaturization of an ink jet recording head. Also, the common cut-off 301*a* formed for the common wall 307 enables the adjacent holes 302 themselves to be communicated. As a result, when adhesive agent is filled in by use of a dispenser or the like, the adhesive agent can be applied to all the holes 302 through the common cut-off 301*a* by filling in the adhesive agent from one cut-off 301, hence making it possible to attempt the simplification of manufacturing process.

In this respect, the elastic member 305 of the present embodiment is fundamentally the same as the elastic member 105 described in conjunction with the embodiment 3-1 regarding such aspect as only the adhesive agent having resistance to ink that may be in contact with ink directly, the material of the elastic member 305, or the like, with the exception of the structure which is made to meet the requirement of narrower pitch formation of the ink supply paths for an ink jet recording head.

As described above, for the ink jet recording head of the present embodiment, it is only the adhesive agent provided with resistance to ink that may be in contact with ink directly. The elastic member 305 is structured so as not to be in contact with ink. Thus, the present embodiment, too, can suppress the defects in discharging ink due to dust particles or impurities adhering to the elastic member 305 or the elution of rubber as in the case of the embodiment 3-1. Also, with the communication of the flow paths 110 and the ink supply paths 104, the close contactness of which has been enhanced by use of the adhesive agent and the elastic member 305, it is possible to prevent the air from being mixed in the ink supply paths.

Further, in the case of the present embodiment, it becomes possible to simplify the filling process of adhesive agent, not only because of the pitch between each of ink supply paths which is made narrower in order to meet the miniaturization of an ink jet recording head, but also because of the formation of the common cut-off 301*a*.

(Embodiment 3-3)

Figure 28:
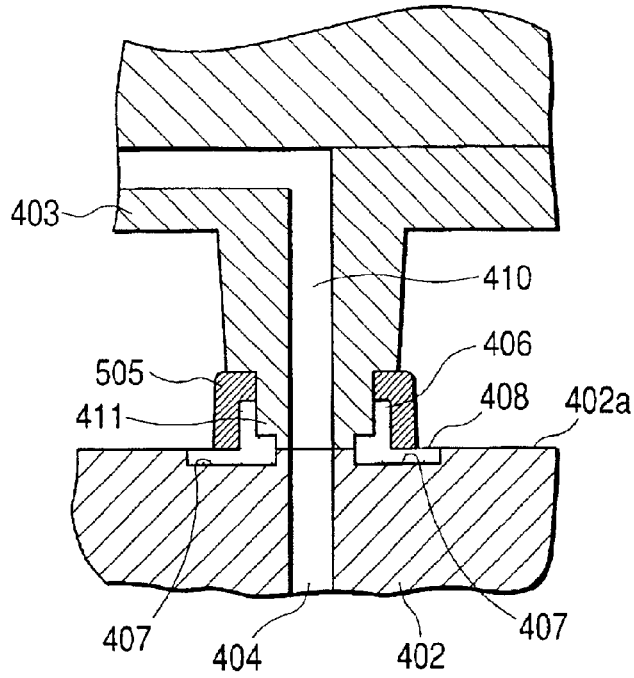
FIG. 28 is an enlarged side sectional view which shows the bonding portion of the flow path formation member and the second base plate of an ink jet recording head in accordance with another embodiment of the present invention.
Figure 29:
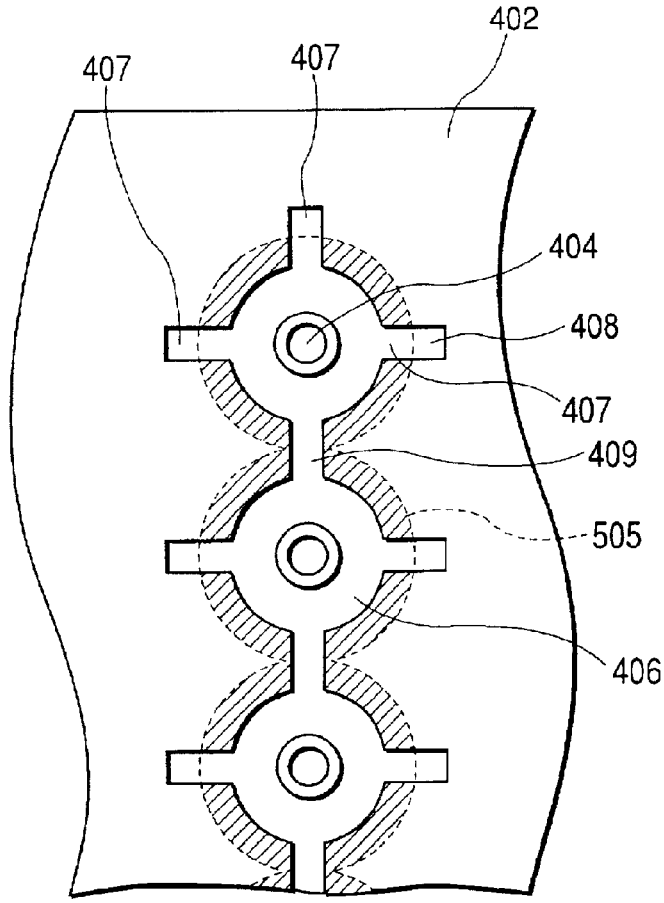
FIG. 29 is a plan view which shows the second base plate in accordance with another embodiment of the present invention.

Next, FIG. 28 is an enlarged side sectional view which shows the coupling portion of the flow path formed for the flow path formation member of the present embodiment, and the ink supply path which is formed for the second base plate. FIG. 29 is a view showing the upper surface of the second base plate represented in FIG. 28.

For the elastic member 505 of the present embodiment, there is formed no cut-off portion like the cut-off porions 201 and 301 of the elastic members 105 and 305 shown respectively in the embodiments 3-1 and 3-2. All the other structures are fundamentally the same. Therefore, the detailed description thereof will be omitted.

In this respect, for the present embodiment, the ink jet recording head having the ink supply paths of narrower pitches as in the one described for the embodiment 3-2, and the elastic member which corresponds thereto are exemplified for description. However, the present invention is not necessarily limited to such examples.

For the second base plate 402, filling grooves 407 are formed with injecting portions 408 for injecting adhesive agent 406. The filling grooves 407 are those conducting the adhesive agent 406 injected from the injection portions 408 to each space formed between the extrusions 411 of the flow path formation member 403 and the elastic member 505. Also, each filling groove 407 is communicated with each of the adjacent filling grooves 407 by use of the communicating grooves 409. As a result, when the adhesive agent is filled in by use of a dispenser or the like, the adhesive agent can be filled in all the filling grooves 407 through the communicating grooves 409 if the adhesive agent is filled in from one of the injection portions 408. Therefore, as in the case of the embodiment 3-2, it becomes possible to attempt the simplification of manufacturing process.

The portions of the elastic member 505 other than those facing the filling grooves 407 are closely in contact with the contact surface 402*a* of the second base plate on the face of the elastic member 505 which confronts the close contact surface 402*a* of the second base plate 402 side as indicated by hatching in FIG. 29.

In this respect, for the present embodiment, the description has been made by exemplifying the elastic member 505 having no cut-off portion formed for filling in adhesive agent, but the present invention is not necessarily limited thereto. An elastic member 505 for which cut-off portions are formed may be usable in order to make the filling speed of the adhesive agent faster.

As described above, the ink jet recording head of the present embodiment is structured so as not to allow the elastic member 505 to be in contact with ink. The one that is possibly in contact with ink directly is only the adhesive agent 406 which is provided with resistance to ink. Thus, the present embodiment, too, can suppress the defects in discharging ink due to dust particles or impurities adhering to the elastic member 505 or the elution of rubber as in the case of the embodiments 3-1 and 3-2. Also, with the communication of the flow paths 410 and the ink supply paths 404, the close contactness of which has been enhanced by use of the adhesive agent 405 and the elastic member 305, it is possible to prevent the air from being mixed in the ink supply paths.

Also, as in the case of the embodiment 3-2, it is made possible for the present embodiment to simplify the filling process of adhesive agent, not only because of the pitch between each of ink supply paths which is made narrower in order to meet the miniaturization of an ink jet recording head, but also because of the formation of the communicating grooves 409.

<Fourth Embodiment>

(Head Cartridge H1000)

In conjunction with FIG. 30, the description will be made of the head cartridge H1000 which constitutes a part of a printing unit.

Figure 30:
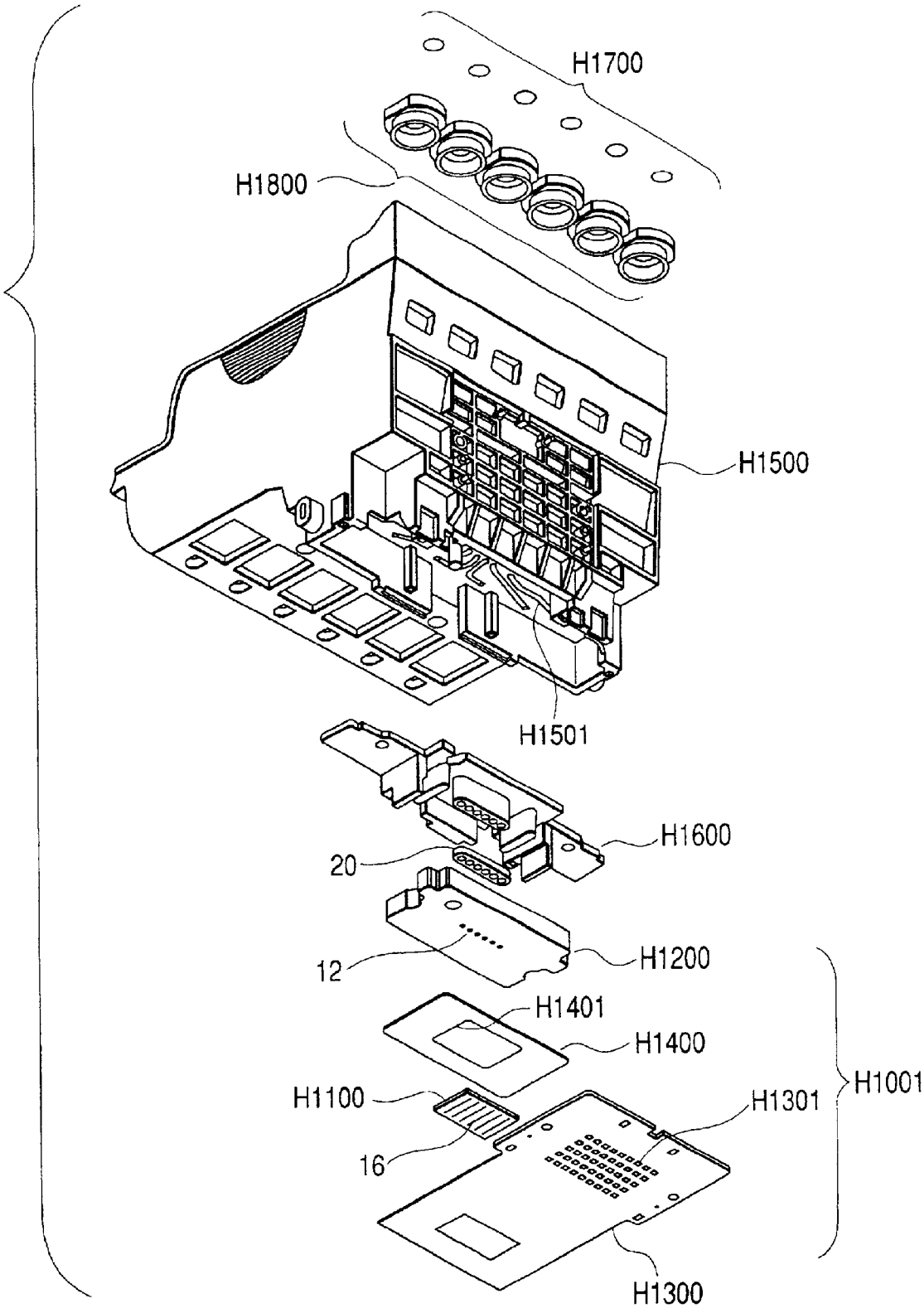
FIG. 30 is an exploded perspective view which shows a head cartridge, observed from diagonally below.

The head cartridge H1000 of the present embodiment comprises the tank holder H1500 which serves as the connecting unit of the liquid tank of the present invention provided with the ink tank H1900 installed for containing ink as shown in FIG. 30; the printing head H1001 that discharges from the discharge ports 16 ink to be supplied from the ink tank H1900 through the tank holder 1500 in accordance with printing information; and the elastically deformable sealing member 20 which is installed on the abutting faces of these members. The head cartridge H1000 is arranged to be detachably mountable on the carriage M4001 which will be described later, that is, the so-called cartridge system is adopted therefor.

For the head cartridge H1000 shown here, there are prepared ink tanks H1900 each individually containing black, light cyan, light magenta, cyan, magenta, and yellow, for example, so as to make a photographic high quality color printing possible. Then, with the operation of the deformable lever H1901 for removable use which is arranged for each of the ink tanks H1900 and made capable of hooking each of them to the head cartridge H1000, each of the ink tanks can be removed from the tank holder H1500 of the printing head H1001.

As shown in the exploded perspective view of FIG. 30, the printing head H1001 comprises a head substrate H1100; a base plate H1200; an electric wiring board H1300, a supporting plate H1400, and others. Then, the tank holder H1500 comprises a flow path formation member H1600; a filter H1700; a sealing rubber H1800, and others.

For the head substrate H1100, there are formed by means of film formation technologies and techniques a plurality of electrothermal converting devices that discharge ink, and an electric wiring, such as formed by Al, that supplies electric power to each of the electrothermal converting devices which serves as discharge energy generating portion of the present invention as described later. Then, a plurality of discharge ports 16 that correspond to the electrothermal converting devices are formed by means of photolithographic techniques, while the ink flow paths are formed to be open to the backside for supplying ink to a plurality of ink paths. The head substrate H1100, which will be described later further in detail, is adhesively fixed to the base plate H1200. Here, the ink supply paths H1201 are formed to supply ink to the head substrate H1100. Further, to the base plate H1200, the supporting plate with the opening portion H1401 is adhesively fixed. Then, to the supporting plate H1400, the electric wiring board H1300 is bonded so that the electric wiring board H1300 is electrically connected with the head substrate H1100. The electric wiring board H1300 is the one used for applying electric signals to the head substrate H1100 for discharging ink, and comprises the electric wiring that corresponds to the head substrate H1100, and the external signal input terminal H1301 which is positioned at the end portion of the electric wiring to receive electric signals from the printer main body M1000. The external signal input terminal H1301 is positioned and fixed to the backside of the tank holder H1500.

To the tank holder H1500 that holds each of the ink tanks H1900 detachably, the flow path formation member H1600 is fixed by means of ultrasonic welding, for example, and the ink flow path H1501 is formed from each of the ink tanks H1900 up to the flow path formation member H1600. The filter H1700 is provided for the ink tank side end portion of the ink flow path H1501 which engages with each ink tank H1900 to make it possible to prevent dust particles from entering from the outside. For the coupling portion with each of the ink tanks H1900, the sealing rubber H1800 is installed to make it possible to prevent ink evaporation from the coupling portion.

The tank holder H1500, which is provided with the flow path formation member H1600, the filter H1700, the sealing rubber H1800, and others, is bonded by use of adhesive agent or the like with the printing head H1001, which is formed by the head substrate H1100, the base plate H1200, the electric wiring board H1300, the supporting plate H1400, and others, through the elastically deformable sealing member 20 inclusively installed on the abutting faces of these members. Thus, the head cartridge H1000 is structured. As regard the sealing member 20, the description will be made later.

(Sealing Member 20)

Figure 31:
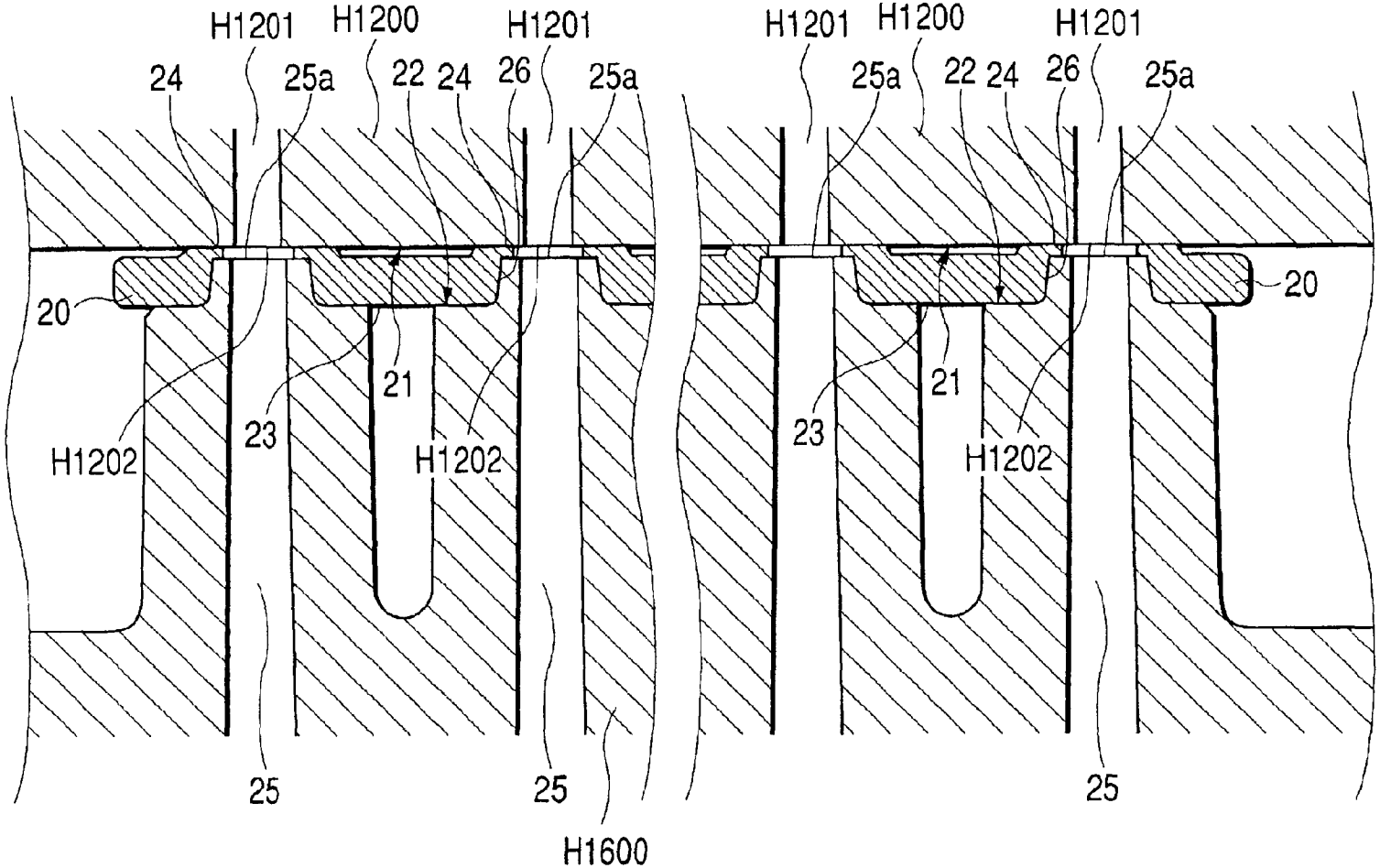
FIG. 31 is a sectional view of the connecting portion of a print head and a tank holder in accordance with another embodiment of the present invention, which is extracted and shown in enlargement.
Figure 32:
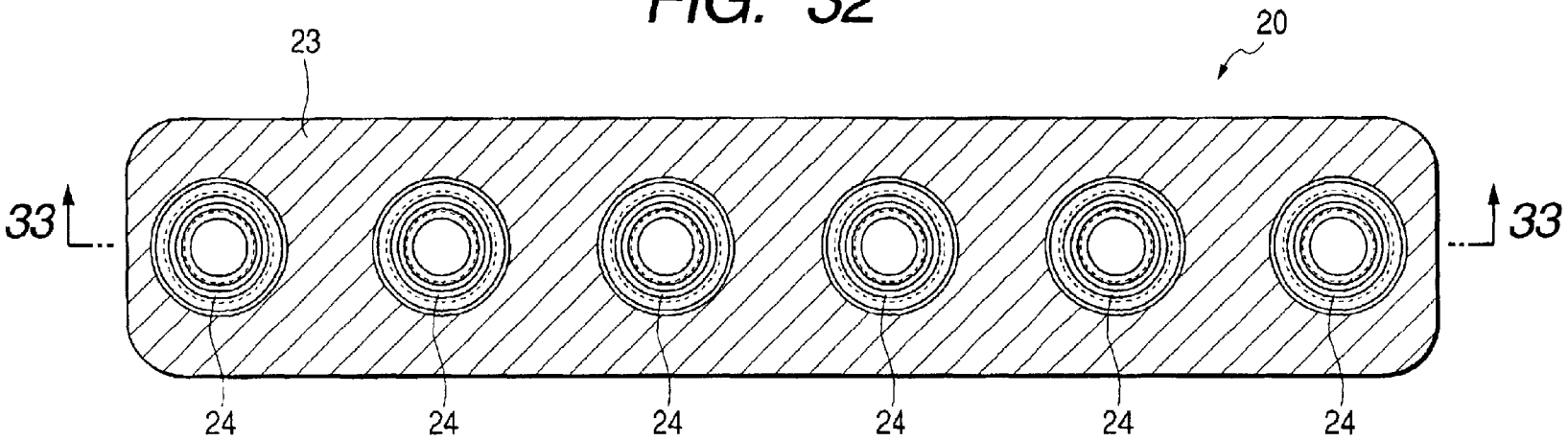
FIG. 32 is a plan view which shows a sealing member in accordance with another embodiment of the present invention.
Figure 33:
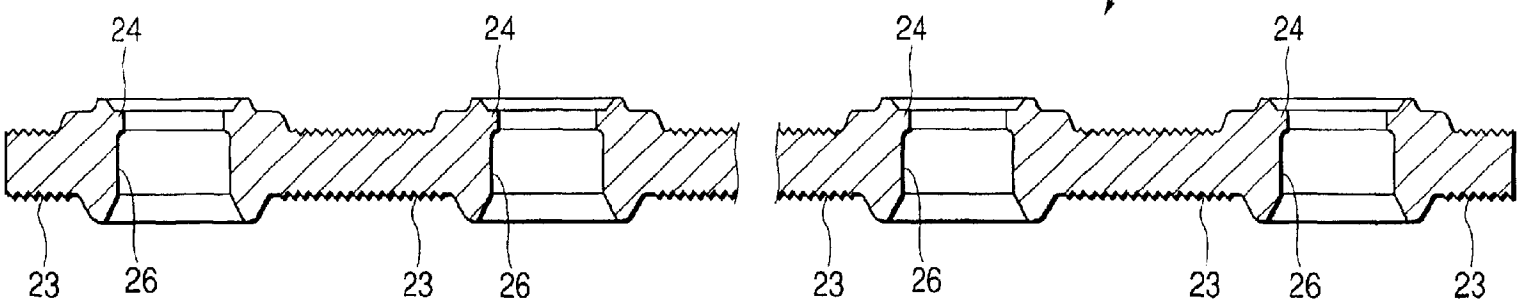
FIG. 33 is a sectional view taken along line 33—33 in FIG. 32.

FIG. 31 shows the sectional structure of the coupling portion of the flow path formation member H1600 that forms a part of the tank holder H1500 and the base plate H1200 that forms a part of the printing head H1001. FIG. 32 shows the surface configuration of the sealing member 20 of the present embodiment. FIG. 33 shows the sectional structure taken along line 33—33 in FIG. 32. In other words, the sealing member 20 of the present embodiment is formed by chlorinated butyl rubber the hardness of which is 30 to 50 (JIS A), and extended along each of the abutting faces 21 and 22 of the base plate H1200 and the flow path formation member H1600, comprising the mat portion 23 having satin surface finish, and a plurality of sealing portions 24 each having a flat and smooth surface, which protrudes from the mat portion 23 in circular.

The surface of the mat portion 23 is processed by sand blast process using polishing particles, each granular diameter of which is 10 to 30 $\mu$m, for example. The average roughness (Ra) on the center line thereof is within a range of 10 to 50 $\mu$m. As a result, when a number of sealing members 20 are handled, each of them can be prevented from sticking to each other, because the flat mat portion 23 has satin surface finish, thus making it easier to handle them. Further, there is no need for using a material having a large hardness as in the conventional art. Now, the sealing capability can be secured in good condition by use of soft material.

The sealing member 20 is in circular to surround the opening, namely the port H1202, that forms the communicating passage to enable the opening end of the ink supply path H1201 formed for the base plate H1200 to be communicated with the opening end of the ink flow path 25 that faces it exactly, that is, the port 25*a* formed for the flow path formation member H1600. For the present embodiment, a fitting portion 26, the section of which is formed in a cup shape, is arranged for each of the sealing portions 24, respectively, corresponding to each of the ports 25*a* of ink flow paths 25 formed for the flow path formation member H1600. The surface roughness of the sealing member 24 is such that when the base plate H1200 and the flow path formation member H1600 are bonded with the sealing member 20 being placed between them, no ink leakage may take place externally from these portions H1202 and 25*a*, that is, the roughness is set 10 $\mu$m or less as the average roughness (Ra) on the center line, for example. Then, the sealing member is in contact with the abutting faces 21 and 22 of the base plate H1200 and the flow path formation member H1600 under pressure with the accompanying elastic deformation.

In this respect, the abutting face 21 of the alumina base plate H1200 is finished by means of the polishing process to provide the average roughness (Ra) of 0.5 $\mu$m or less on the center line. Thus, the port H1202 of the ink supply path H1201 formed for the base plate H1200 can be communicated with the port 25*a* of the ink flow path 25 formed for the flow path formation member H1600 reliably through the sealing member 20 without any liquid leakage. Further, it is effective to form a flat and smooth layer for the abutting face 21 of the base plate H1200 for the enhancement of the close contact with the sealing member 20. As this flat and smooth layer, a silicone sealant, such as TSE 399 (manufactured by Toshiba Silicone Co.,Ltd.) may be usable.

Figure 34:
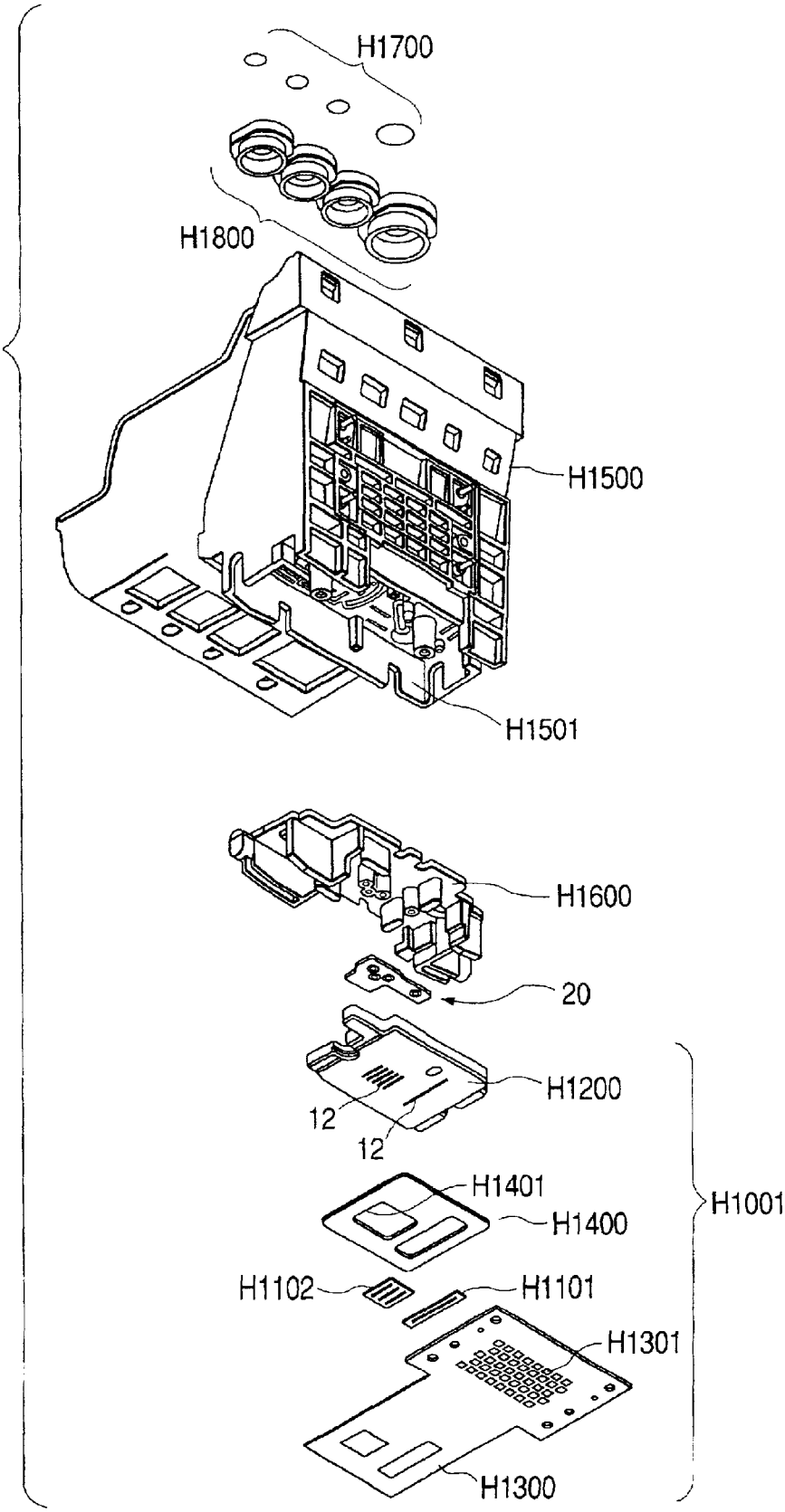
FIG. 34 is an exploded perspective view which shows an head cartridge in accordance with another embodiment of the present invention.
Figure 35:
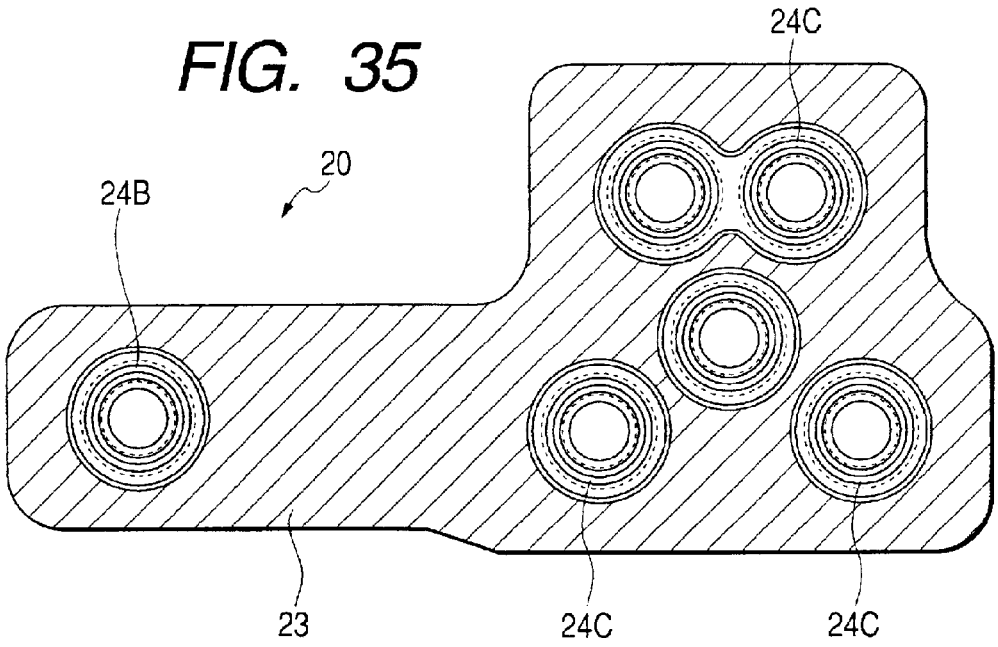
FIG. 35 is a plan view which shows a sealing member used for the embodiment represented in FIG. 34.

For the present embodiment described above, the description has been made of the case where six ports H1202 of the ink supply paths H1201 formed for the base plate H1200 are arranged at designated intervals. However, if these ink supply paths H1201 should be distributed unevenly, there is a need for the use of a sealing member formed with the sealing portions which are arranged accordingly. For example, as shown in FIG. 34 which represents an exploded structure of another embodiment of the head cartridge H1000 of the present invention, if a printing head H1001 is used with the adoption of an elongated head base plate H1101 having many numbers of discharge ports for discharging black ink, and a shorter head base plate H1102 having a smaller number of discharge ports corresponding to each individual color ink other than black, that is, yellow ink, magenta ink, cyan ink, for example, which are arranged apart from each other, a sealing portion 24B for black color ink to pass, and sealing portions 24C for ink of other colors to pass are formed away from each other as shown in FIG. 35. Then, a sealing member 20 can be used only with a mat portion having a wider area, which inclusively exists among them. Here, in FIGS. 34 and 35, the same reference marks are applied to the members having the same functions as those appearing in the previous embodiment.

In a case of the sealing member 20 having a mat portion 23 of wider area such as this, there is a higher possibility that the members are allowed to stick to each other when being handled. However, with the mat portion 23 having satin surface finish as in the present embodiment, such drawback as the members may stick to each other can be prevented for easier handling, and, moreover, there is no need for use of a material having a large hardness as in the conventional art to make it possible to use a soft material to secure a sealing capability in better condition.

In this respect, it is needless to mention that the present invention includes a mode in which the embodiments described above, and all or a part of the embodiments are combined with each other for execution.

Figure 36:
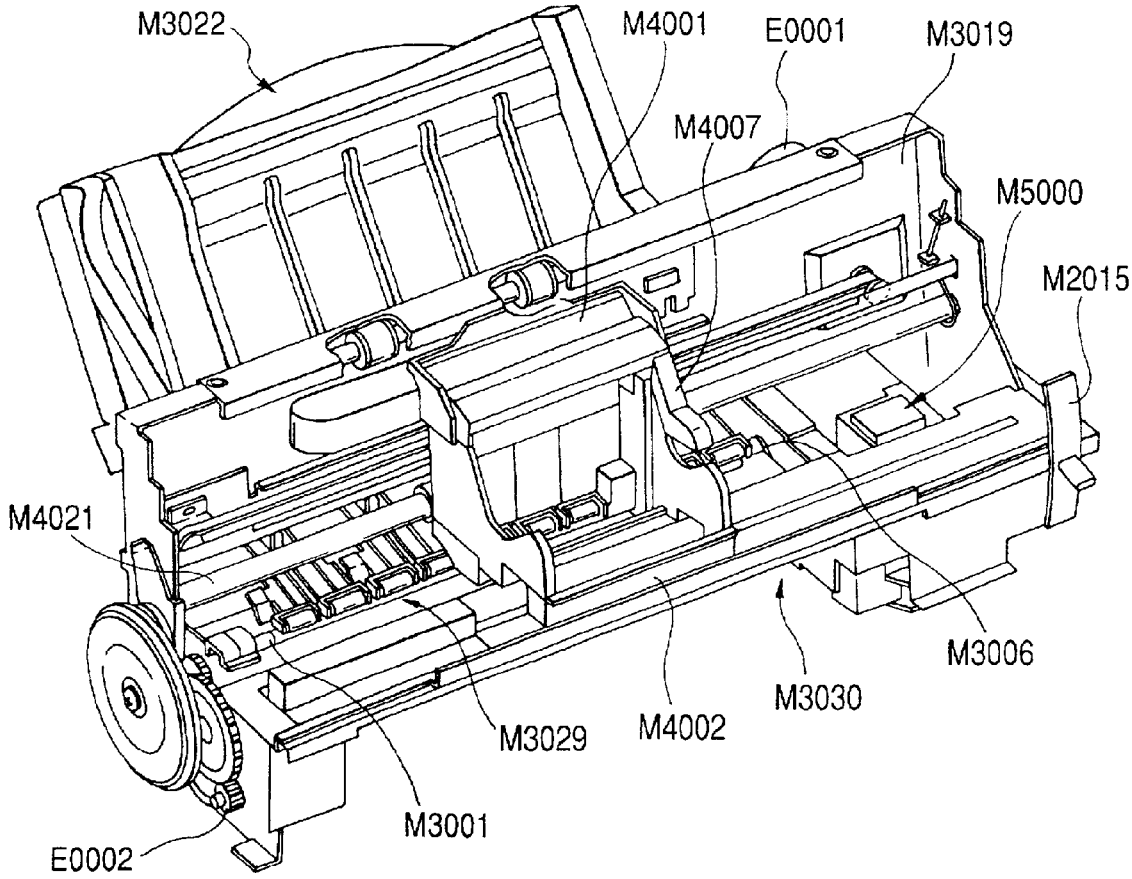
FIG. 36 is a perspective view of a print operation mechanism as a main portion of an ink jet printer which shows one embodiment of the liquid discharge recording apparatus according to the present invention.

FIG. 36 is a perspective view of a print operation mechanism as a main portion of an ink jet printer which shows one embodiment of the liquid discharge recording apparatus according to the present invention. The print operation mechanism includes an automatic feeding portion M3022 for automatically feeding a print medium, a conveying portion M3029 for guiding the print medium which is fed one-by-one from the automatic feeding portion M3022 to a desired print portion and guiding the print medium from a print position to an expelling portion M3030, a print portion for performing a predetermined printing on the print medium conveyed to the print position and a recovery portion M5000 for performing a recovery operation for the print portion etc. The print portion a carriage M4001 movably supported by a carriage shaft M4021 and a head cartridge H1000 removably mounted on the carriage M4001. The carriage M4001 mounting the head cartridge H1000 is provided with a carriage cover M4002 for guiding the head cartridge H1000 to a predetermined mounting position on the carriage M4001 and a head selector lever M4007 engaged with a tank holder H1500 of the head cartridge H1000 to press and set the head cartridge H1000 at the predetermined mounting position.

What is claimed is:

1. A liquid discharge head cartridge comprising:

a recording element unit including a plate member provided with liquid supply paths for supplying liquid to a recording element base plate for performing recording operation by discharging liquid;

a liquid supply unit portion provided with communication passage for conducting liquid from the liquid supply source for supplying liquid to send out said liquid through said communication passage, and an elastic sealing member arranged between one end portion of the liquid supply path of the plate member of said recording element unit and the end portion facing one end portion of said liquid supply path on the communication passage of said liquid supply unit portion, and provided with liquid flow paths communicating with said liquid supply paths and said communication passage to seal between one end portion of liquid supply paths of said recording element unit and the communication passage of said liquid supply unit portion, wherein said liquid supply unit portion and said recording element unit are adhesively bonded with each other for coupling on the bonding face portions other than the locations having said elastic sealing member arranged in compression.

2. A liquid discharge recording head cartridge according to claim 1, wherein said elastic sealing member is provided with ribs on the portion facing one end portion of the liquid supply paths of said recording element unit to surround each opening end portion of said liquid flow paths, while abutting against said portion.

3. A liquid discharge recording head cartridge according to claim 1, wherein said elastic sealing member is formed by chlorinated butyl rubber.

4. A liquid discharge recording head cartridge according to claim 1, wherein said elastic sealing member provides the contact pressure of 5 (N) or more and 30 (N) or less.

5. A liquid discharge recording bead cartridge according to claim 1, wherein the plate member of said recording element unit is formed by either one of silicon, alumina, aluminum nitride, silicon carbide, molybdenum, and tungsten.

6. A liquid discharge recording head cartridge according to claim 1, wherein said liquid supply unit portion and said recording element unit are adhesively bonded by use of epoxy adhesive agent or ultraviolet hardening adhesive agent.

7. A liquid discharge recording head cartridge according to claim 6, wherein said liquid supply unit portion and said recording unit are adhesively bonded on plural locations for coupling.

8. A liquid discharge recording head cartridge according to claim 6, wherein when said liquid supply unit portion end said recording unit are adhesively bonded by use of epoxy adhesive agent or ultraviolet hardening adhesive agent, said recording element unit is held by a holding member against said liquid supply unit portion.

9. A liquid discharge recording head cartridge according to claim 1, wherein the contact face of said liquid supply unit portion is given a reforming process.

10. A liquid discharge recording head cartridge according to claim 9, wherein said reforming process is a high frequency corona surface treatment or an oxygen plasma treatment.

* * * * *

UNITED STATES PATENT AND TRADEMARK OFFICE

CERTIFICATE OF CORRECTION

PATENT NO. : 6,910,759 B2
DATED : June 28, 2005
INVENTOR(S) : Shogo Kawamura et al.

It is certified that error appears in the above-identified patent and that said Letters Patent is hereby corrected as shown below:

Column 1,
Line 35, “that” should read -- that are --.
Line 53, “been” should read -- been in --.

Column 3,
Line 23, “thus,” should read -- Thus, --.
Line 55, “of” (first occurrence) should be deleted, and “ranged” should read -- range --.

Column 5,
Line 24, “secured” should read -- secure --.

Column 6,
Line 30, “views” should read -- view --.

Column 7,
Line 19, “shows an” should read -- shows a --.

Column 8,
Line 67, “supply” should read -- supplying --.

Column 9,
Line 15, “form” should read -- from --.
Line 36, “supply” should read -- supplying --.

Column 11,
Line 1, “hail” should read -- nail --.
Line 5, “released” should read -- released to --.

Column 12,
Line 33, “H11001” should read -- H1101 --.
Line 34, “plat H1200” should read -- plate H1200 --.

Column 14,
Line 45, “bass” should read -- boss --.

Column 17,
Line 39, “thee” should read -- the --.

UNITED STATES PATENT AND TRADEMARK OFFICE

CERTIFICATE OF CORRECTION

PATENT NO. : 6,910,759 B2
DATED : June 28, 2005
INVENTOR(S) : Shogo Kawamura et al.

It is certified that error appears in the above-identified patent and that said Letters Patent is hereby corrected as shown below:

Column 19,
Line 23, “older” should read -- holder --.
Line 37, “only” should read -- only does --, and “becomes” should read -- become --.

Column 20,
Line 37, “form” should read -- from --.
Line 45, “martial,” should read -- material, --.
Line 67, “chrolinated” should read -- chlorinated --.

Column 21,
Line 28, “a” should read -- σ --.
Line 62, “describe” should read -- described --.

Column 22,
Line 8, “(produce” should read -- (product --.
Line 21, “nit” should read -- unit --.
Line 28, “a” should read -- an --.
Line 29, “agent” should read -- agents --.

Column 23,
Line 1, “palate” should read -- plate --.
Line 61, “other” should be deleted.
Line 62, “colors” should read -- colors other --.

Column 26,
Line 3, “discharge” should read -- discharged --.

Column 27,
Line 27, “is” should read -- are --, and “porions” should read -- portions --.

Column 29,
Line 36, “As regard” should read -- Regarding --.

Column 31,
Line 34, “communication” should read -- a communication --.
Line 37, “passage,” should read -- passage; --.

UNITED STATES PATENT AND TRADEMARK OFFICE

CERTIFICATE OF CORRECTION

PATENT NO. : 6,910,759 B2
DATED : June 28, 2005
INVENTOR(S) : Shogo Kawamura et al.

It is certified that error appears in the above-identified patent and that said Letters Patent is hereby corrected as shown below:

Column 32,
Line 33, "end" should read -- and --.

Signed and Sealed this

Seventh Day of February, 2006

JON W. DUDAS
*Director of the United States Patent and Trademark Office*